US008061287B2

(12) United States Patent
Hayakawa et al.

(10) Patent No.: US 8,061,287 B2
(45) Date of Patent: Nov. 22, 2011

(54) SEWING DATA PROCESSING APPARATUS, SEWING MACHINE EQUIPPED WITH SEWING DATA PROCESSING APPARATUS, AND COMPUTER-READABLE RECORDING MEDIUM WITH RECORDED SEWING DATA PROCESSING COMPUTER PROGRAM

(75) Inventors: Atsuya Hayakawa, Chita (JP); Satoru Makino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1091 days.

(21) Appl. No.: 11/902,878

(22) Filed: Sep. 26, 2007

(65) Prior Publication Data

US 2008/0190339 A1 Aug. 14, 2008

(30) Foreign Application Priority Data

Sep. 28, 2006 (JP) ..... 2006-264287

(51) Int. Cl.
*D05B 19/00* (2006.01)

(52) U.S. Cl. ..... 112/470.04; 112/470.01

(58) Field of Classification Search ..... 700/136–138; 112/102.5, 470.01, 470.04, 453, 475.09, 112/475.18, 475.19

See application file for complete search history.

(56) References Cited

U.S. PATENT DOCUMENTS

| | | | | |
|---|---|---|---|---|
| 5,855,176 | A * | 1/1999 | Takenoya et al. | 112/102.5 |
| 7,058,471 | B2 * | 6/2006 | Watanabe | 112/475.09 |

FOREIGN PATENT DOCUMENTS

| | | |
|---|---|---|
| JP | U-64-013575 | 1/1989 |
| JP | A-01-126995 | 5/1989 |
| JP | B2-06-067422 | 8/1994 |
| JP | A-09-269966 | 10/1997 |
| JP | A-11-004984 | 1/1999 |
| JP | A-11-015377 | 1/1999 |
| JP | A-2000-008269 | 1/2000 |
| JP | A-2004-118404 | 4/2004 |

* cited by examiner

*Primary Examiner* — Nathan Durham
(74) *Attorney, Agent, or Firm* — Oliff & Berridge, PLC

(57) ABSTRACT

A sewing data processing apparatus which may be used to attach an IC tag to a work cloth without impairing a design of the work cloth. The processing apparatus may acquire an IC tag area on the basis of a size and shape of the IC tag and subsequently may determine whether the IC tag area can be included in an applique pattern area which is determined on the basis of applique pattern data. If the IC tag area can be included in the applique pattern area, positions of the applique pattern area and the IC tag area may be set in such a manner that the IC tag area is positioned in the applique pattern area.

22 Claims, 27 Drawing Sheets

SEWING DATA PROCESSING APPARATUS, SEWING MACHINE EQUIPPED WITH SEWING DATA PROCESSING APPARATUS, AND COMPUTER-READABLE RECORDING MEDIUM WITH RECORDED SEWING DATA PROCESSING COMPUTER PROGRAM

CROSS-REFERENCE TO RELATED APPLICATION

The present application claims priority from Japanese Patent Application No. 2006-264287, which was filed on Sep. 28, 2006, the disclosure of which is herein incorporated by reference in its entirety.

BACKGROUND

The present disclosure relates generally to technical fields including a sewing data processing apparatus that processes sewing data used to sew a cloth piece having a size and shape determined by applique pattern data to a work cloth by using a sewing machine so that an applique pattern of the cloth piece is formed on the work cloth, a sewing machine equipped with the sewing data processing apparatus, and a computer-readable recording medium with a recorded sewing data processing program.

In the related art, a technology is known for utilizing an optically-readable mark attached to a work cloth in production of the work cloth, management of products for sales of the products, or display of a quality of the work cloth.

The mark is directly printed to a fabric or printed to a piece of paper or cloth which is to be attached to the fabric. In such cases, depending on the handling of the fabric, the mark can be partially or totally lost, or separated due to water and chemicals used in various processing steps. To solve this problem, a sewing machine has been proposed which forms an optically-readable mark by sewing it to the work cloth (see Japanese Patent Application Laid Open Publication No. Hei 6-67422). The mark that is sewn to the work cloth by the sewing machine generally has low occurrence of being lost or separated from the work cloth, and may also be protected from deformation.

SUMMARY

However, when a mark is directly sewn to the work cloth, the mark may badly affect the appearance and design of the work cloth. Also, generally an amount of information added to the mark formed by sewing is not sufficient, and there is a desire to give much more information to the work cloth.

It is one object of the present disclosure to provide a sewing data processing apparatus that can attach an IC tag (i.e., integrated circuit) capable of storing a lot of information to a work cloth without damaging a design of the work cloth, a sewing machine equipped with the sewing data processing apparatus, and a computer-readable recording medium in which a sewing data processing computer program is recorded.

According to a first aspect of the present disclosure, there is provided a sewing data processing apparatus which processes sewing data used to sew a cloth piece having a size and shape which is determined by applique pattern data to a work cloth by using a sewing machine so that an applique pattern including the cloth piece may be formed on the work cloth, the apparatus comprising: an IC tag area acquisition device that acquires an IC tag area which is determined on the basis of a size and shape of an IC tag; a determination device that determines whether the IC tag area which is acquired by the IC tag area acquisition device can be included in an applique pattern area which is determined on the basis of the applique pattern data; and a location setting device that, if the determination device determines that the IC tag area can be included in the applique pattern area, sets positions of the applique pattern area and the IC tag area in a sewable area of the sewing machine in such a manner that the IC tag area is positioned in the applique pattern area.

According to a second aspect of the present disclosure, there is provided a sewing data processing apparatus which processes sewing data used to sew a cloth piece having a size and shape which is determined by applique pattern data to a work cloth by using a sewing machine so that an applique pattern including the cloth piece may be formed on the work cloth, the apparatus comprising: an IC tag area acquisition device that acquires an IC tag area which is determined on the basis of a size and shape of an IC tag; a location specification device that specifies a position of an applique pattern area obtained on the basis of the applique pattern data and a position of the IC tag area in a sewable area of the sewing machine; a determination device that determines whether the IC tag area is included in the applique pattern area when the IC tag area and the applique pattern area positioned at the positions specified by the location specification device; and a location setting device that, if the determination device determines that the IC tag area is included in the applique pattern area, sets positions of the applique pattern area and the IC tag area to the positions specified by the location specification device in the sewable area of the sewing machine.

According to a third aspect of the present disclosure, there is provided a computer-readable recording medium storing a sewing data processing program which processes sewing data used to sew a cloth piece having a size and shape which is determined by applique pattern data to a work cloth by using a sewing machine so that an applique pattern including the cloth piece may be formed on the work cloth, the program comprising: IC tag area acquisition instructions for acquiring an IC tag area which is determined on the basis of a size and shape of an IC tag; determination instructions for determining whether the IC tag area which is acquired during execution of the IC tag area acquisition instructions can be included in an applique pattern area which is determined on the basis of the applique pattern data; and position setting instructions for setting the positions of the applique pattern area and the IC tag area in a sewable area of the sewing machine in such a manner that the IC tag area is located in the applique pattern area if, during execution of the determination instructions, it is determined that the IC tag area can be included in the applique pattern area.

According to a fourth aspect of the present disclosure, there is provided a computer-readable recording medium storing a sewing data processing program which processes sewing data used to sew a cloth piece having a size and shape determined by applique pattern data to a work cloth by using a sewing machine so that an applique pattern including the cloth piece may be formed on the work cloth, the program comprising: IC tag area acquisition instructions for acquiring an IC tag area which is determined on the basis of a size and shape of an IC tag; a location specification instructions for specifying a position of an applique pattern area obtained on the basis of the applique pattern data and a position of the IC tag area in a sewable area of the sewing machine; determination instructions for determining whether the IC tag area is included in the applique pattern area when the IC tag area and the applique pattern area are positioned at the positions specified during execution of the location specification instructions; and location setting instructions for setting the positions of the applique pattern area and the IC tag area to the positions specified during execution of the location specification instructions in the sewable area of the sewing machine.

BRIEF DESCRIPTION OF THE DRAWINGS

Exemplary embodiments will be described in detail with reference to the accompanying drawings in which.

DETAILED DESCRIPTION OF EMBODIMENTS

Exemplary embodiments of the broad principles outlined herein are described. The following will sequentially describe various embodiments of a sewing data processing apparatus, with reference to the drawings. A sewing data processing apparatus according to a first embodiment may be integrated with a sewing machine that forms stitches on a work cloth by moving the work cloth relative to a vertically moving needle. It should be noted that the sewing data processing apparatus may be separated from the sewing machine. First, a physical configuration and an electrical configuration of a sewing machine 1 according to a first embodiment will be described below.

First, the physical configuration of the sewing machine 1 will be described below with reference to FIG. 1.

Figure 1:
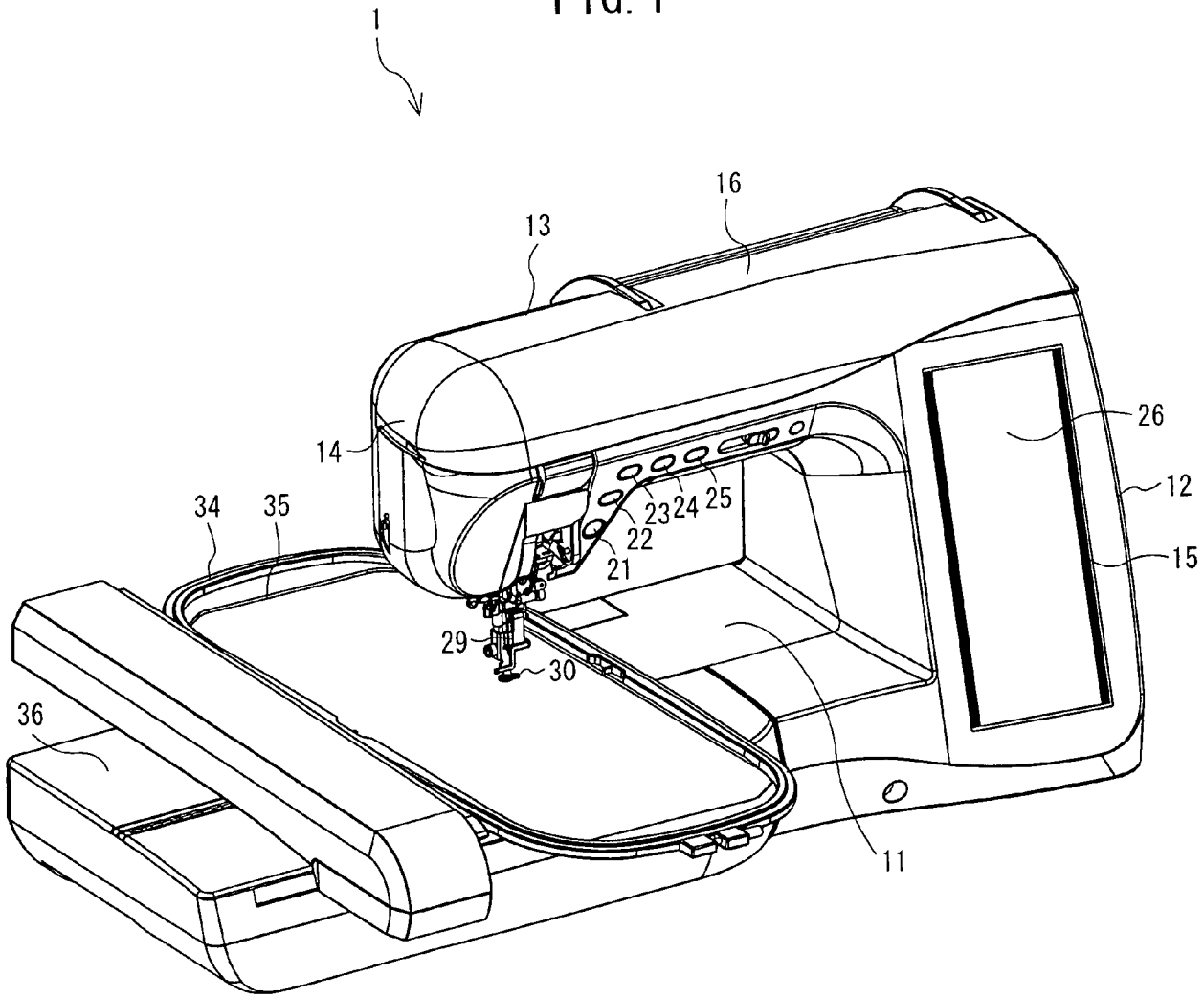
FIG. 1 is a perspective view of a sewing machine.

As shown in FIG. 1, the sewing machine 1 may have a horizontally long sewing machine bed 11, a pillar 12 erected upward at the right end of the sewing machine bed 11, an arm portion 13 extending leftward from the upper end of the pillar 12 in FIG. 1, and a head portion 14 provided at the left end of the arm portion 13. The sewing machine bed 11 may be loaded with an embroidery frame 34 that may frame a work cloth (not shown). The embroidery frame 34 may be arranged to be moved by an embroidery frame movement mechanism 36 to an arbitrary position based on an X-Y coordinate system intrinsic to the apparatus. As the work cloth is arbitrarily moved by the embroidery frame movement mechanism 36, a needle bar and a shuttle mechanism (not shown), may be driven to carry out an embroidery formation operation that may form predetermined stitches or embroidery to the work cloth.

Further, the head portion 14 may be equipped with a needle bar mechanism (not shown), which may vertically drive a needle bar (not shown), mounted with a sewing needle 29, a needle bar swinging pulse motor 80 (see FIG. 2) which swings the needle bar horizontally, and a thread take-up mechanism (not shown). The embroidery frame movement mechanism 36 and the needle bar, etc. may be controlled on the basis of applique pattern data by a control unit which may include a microcomputer built in the sewing machine 1. Although not shown in FIG. 1, an image scanner sensor 27 (see FIG. 2) capable of scanning a size and shape of an IC tag may be attached to a lower surface of the head portion 14 near the needle bar within a sewable area inside an inner periphery 35 of the embroidery frame 34. The image scanner sensor 27 may include, for example, a CCD sensor or a CMOS sensor.

An LCD (liquid crystal display) 15 having a vertically long rectangular shape may be attached to a front surface of the pillar 12. The LCD 15 may indicate various patterns and function names for performing various functions required in sewing as well as a variety of messages. A touch panel 26 may be attached on a front surface of LCD 15. The touch panel 26 may respond to the display positions of various settings such as settings of pattern names of a plurality of patterns and function names for performing various functions, numerical settings of a feed amount of the work cloth by means of a feed adjustment pulse motor 78 (see FIG. 2) and a needle swing amount by means of the needle bar swinging pulse motor 80. Accordingly, by pressing portions on the touch panel 26 that correspond to the patterns and the settings on the screens displayed on the LCD 15 by using a finger or a dedicated touch pen, it is possible to select a pattern to be sewn, specify desired functions, and set desired numerical values.

Although not shown in FIG. 1, a connector 38 (see FIG. 2) may be provided on a right side surface of the pillar 12 in FIG. 1, which can connect an external storage device 39 such as a memory card. Through the connector 38, various kinds of sewing information data and programs from the external storage device 39 can be input to and output from the sewing machine 1.

Next, a configuration of the arm portion 13 will be described below. The arm portion 13 may include an open/close cover 16 for opening and closing its upper side. Inside the open/close cover 16, a thread spool (not shown) may be included for supplying a thread to the sewing needle 29. Although not shown, a needle thread extending from the thread spool may be supplied to the sewing needle 29 mounted to the needle bar after running through a tensioner and a thread take-up spring which may be mounted on the head portion 14 to adjust the thread tension and a plurality of thread hooking portions such as a thread take-up lever which vertically reciprocates to pull up the needle thread.

The arm portion 13 may also include a sewing machine drive shaft (not shown), which extends in the longitudinal direction of the arm portion 13. The sewing machine drive shaft may be driven rotationally by a sewing machine motor 79 (see FIG. 2). The needle bar mechanism and the thread take-up mechanism may be driven by the rotation of the sewing machine drive shaft.

The lower front surface of the arm portion 13 may include a sewing start/stop switch 21, a reverse stitch switch 22, a needle up/down switch 23, a presser foot elevation switch 24, an automatic thread hooking start switch 25, etc. The sewing start/stop switch 21 may command starting and stopping of the sewing machine operation, that is, starting and stopping of sewing. The reverse stitch switch 22 may be used to feed the work cloth from the rear side to the front side, which is the opposite of the ordinary direction. The needle up/down switch 23 may switch the upper and lower stopping positions of the needle bar. The presser foot elevation switch 24 may command the elevation of a presser foot 30. The automatic thread hooking start switch 25 may command starting of automatic thread hooking which hooks a thread over the thread take-up lever, the tensioner, and the thread take-up spring and pass the thread through an eye of the sewing needle 29.

Further, the head portion 14 provided at the left end of the arm portion 13 may include the above-described needle bar, thread take-up lever, tensioner, and thread take-up spring as well as an automatic thread hooking apparatus (not shown), an automatic threading mechanism (not shown), etc. On the rear side of the needle bar, a presser bar (not shown), is arranged which may be supported in such a way that it can be raised and lowered. The lower end of the presser bar may include presser foot 30 for pressing the work cloth.

Figure 2:
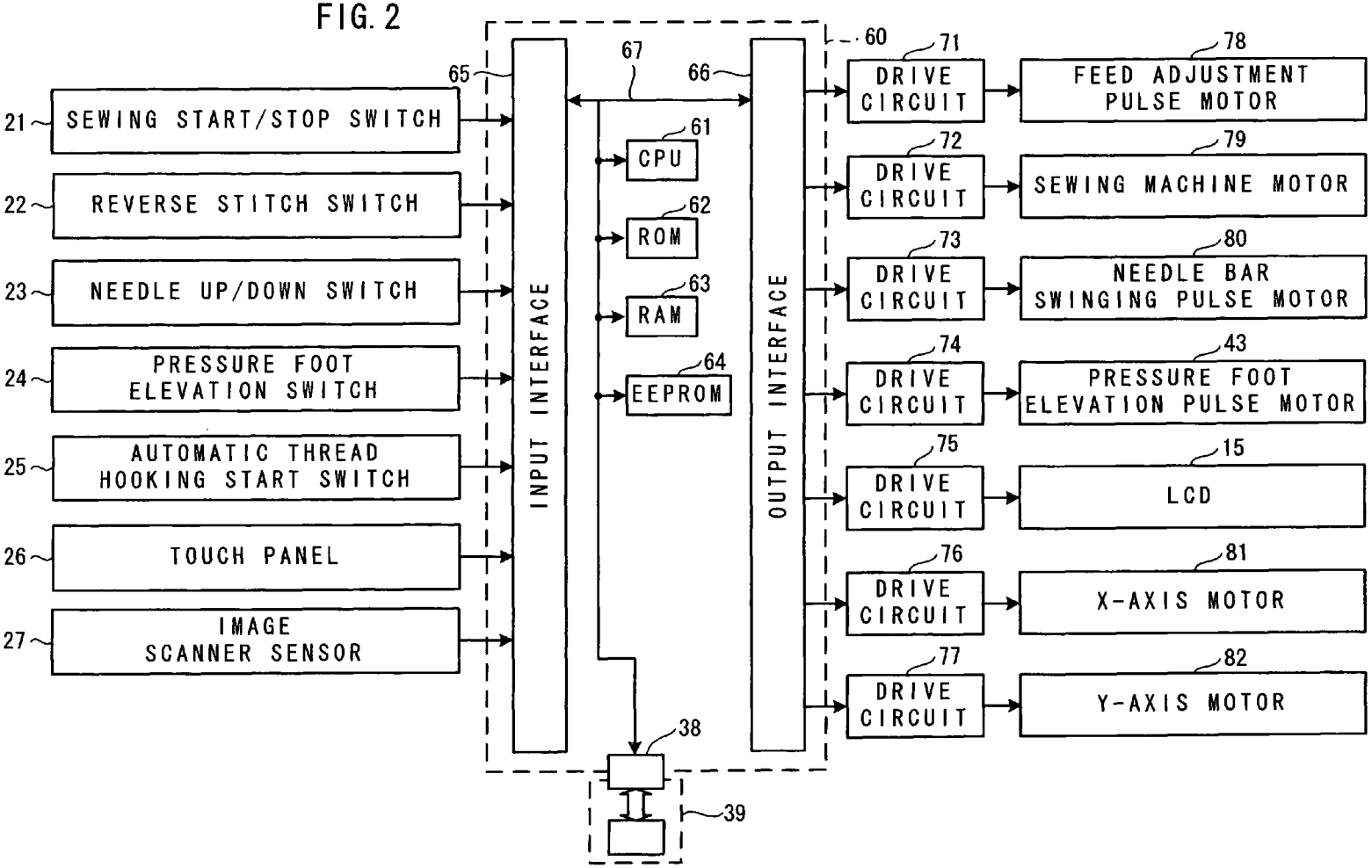
FIG. 2 is a conceptual diagram of an electrical configuration of the sewing machine.
Figure 3:
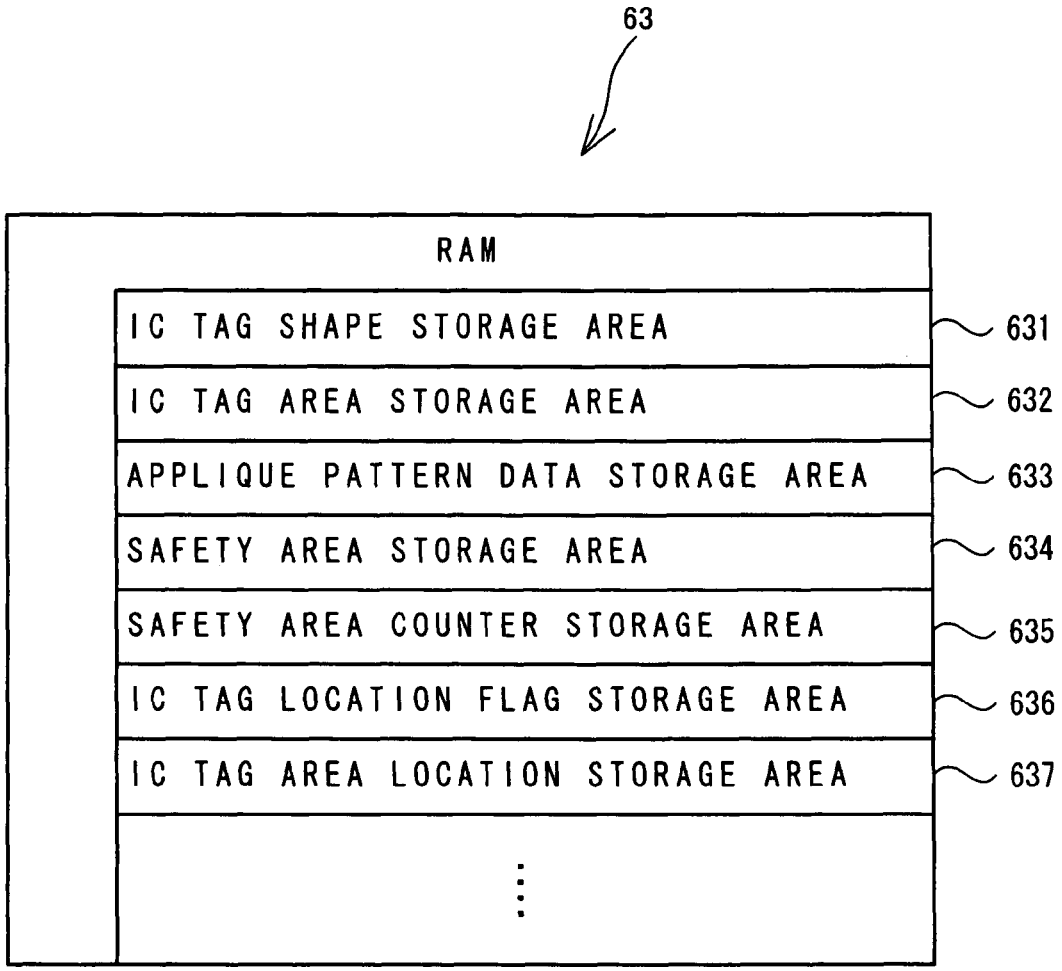
FIG. 3 is a conceptual diagram of storage areas of a RAM.

Next, the electrical configuration of the sewing machine 1 will be described below with reference to FIGS. 2 and 3. As shown in FIG. 2, a control unit 60 of the sewing machine 1 may include a CPU 61, an ROM 62, an RAM 63, an EEPROM 64, an input interface 65, an output interface 66, and the connector 38. These may be connected by a bus 67 to each other. The input interface 65 may be connected with the sewing start/stop switch 21 described above, the reverse stitch switch 22, the needle up/down switch 23, the pressure elevation switch 24, the automatic thread hooking start switch 25, the touch panel 26, and the image scanner sensor 27. On the other hand, the output interface 66 may be electrically connected with the feed adjustment pulse motor 78, the sewing machine motor 79, the needle bar swinging pulse motor 80, a presser foot elevation pulse motor 43, the LCD 15, an X-axis motor 81, and a Y-axis motor 82 via drive circuits 71 through 77 respectively. The feed adjustment pulse motor 78 may adjust a feed amount of the work cloth. The sewing machine motor 79 may rotationally drive the sewing machine drive shaft. The needle bar swinging pulse motor 80 may drive the needle bar (not shown), in a swinging manner. The X-axis motor 81 may drive the embroidery frame 34 in an X-axis direction. The Y-axis motor 82 may drive the embroidery frame 34 in a Y-axis direction. The following will describe in detail the CPU 61, the ROM 62, and the RAM 63 of the control unit 60 of the sewing machine 1.

The CPU 61 may conduct main control on the sewing machine 1, to perform various calculations and processing required in sewing, in accordance with a sewing control program which may be stored in the ROM 62. The CPU 61 may also set positions of an IC tag area and an applique pattern area in the sewable area in accordance with a sewing data processing program which may be stored in the ROM 62. It should be noted that a sewing machine operation program may also be stored in the external storage device such as a memory card. In the case, however, the program is read into the RAM 63 to be executed.

The ROM 62 may have sewing control program storage area in which the sewing control program is stored. The sewing control program may include the drive control of the various drive mechanisms, pattern selection control to select various patterns and various display controls. The ROM 62 may also have a sewing data processing program storage area in which the sewing data processing program is stored. The sewing data processing program may set the positions of the IC tag area and the applique pattern area in the sewable area. It should be noted that these various kinds of sewing information data pieces may be partially or totally stored in the EEPROM 64. Otherwise, the data stored in the external storage device may be read into the sewing machine 1.

The RAM 63 is a random access memory. The RAM 63 may have various storage areas as necessary for storing various kinds of sewing information data read from the ROM 62, various kinds of settings read from the EEPROM 64, and results of calculations performed by the CPU 61. The storage areas of the RAM 63 will be described below in detail with reference to FIG. 3. As shown in FIG. 3, the RAM 63 may have an IC tag shape storage area 631 and an IC tag area storage area 632. The IC tag shape storage area 631 may store, as shape data, form information containing a size and shape of an IC tag. The IC tag area storage area 632 may store an IC tag area determined on the basis of the shape data. The RAM 63 may also include an applique pattern data storage area 633, a safety area storage area 634, a safety area counter storage area 635, and an IC tag location flag storage area 636. The applique pattern data storage area 633 may store applique pattern data. The safety area storage area 634 may store a safety area determined on the basis of applique pattern data. The safety area counter storage area 635 may store a safety area counter, which may be used to read later-described safety pattern areas in sequence. The IC tag location flag storage area 636 may store an IC tag location flag, which may be used to determine whether an IC tag area can be located in an applique pattern area. Also, an IC tag area location storage area 637 may be provided to store the location of IC tag areas which have been set.

As described above, the sewing machine 1 has functions as a sewing data processing apparatus of the present disclosure. Next, processing procedures will be described below of various embodiments for setting the positions of the IC tag area and the applique pattern area in the sewable area by using the sewing machine 1 having the above-described configuration.

Figure 4:
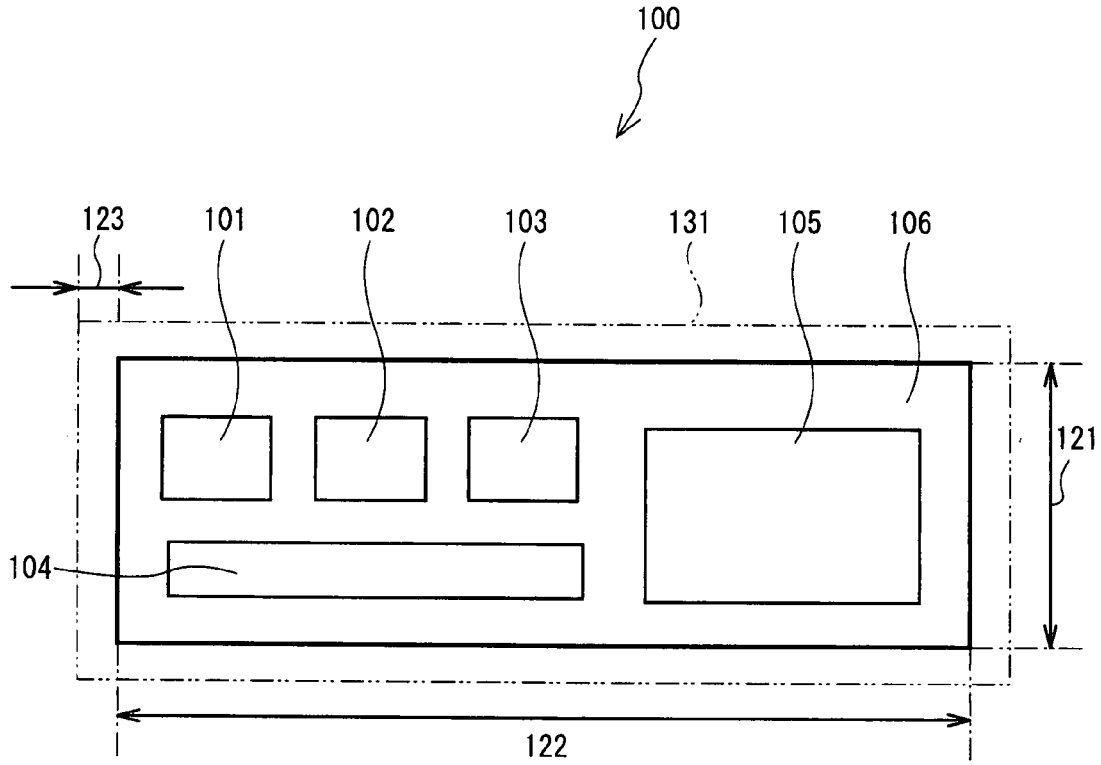
FIG. 4 is an explanatory diagram of an IC tag which is used in Example 1.

First, the main processing which may be performed by the sewing machine 1 in one embodiment will be described below with reference to FIGS. 4 through 15. As Example 1, a case will be described below where the IC tag shown in FIG. 4 is covered by an applique pattern 200 shown in FIGS. 5 through 7. First, an IC tag 100 and the applique pattern 200 of Example 1 will be described below with reference to FIGS. 4 though 7.

First, as one example of the IC tag, the IC tag 100 of Example 1 will be described below with reference to FIG. 4. The IC tag 100 has a configuration similar to that of the IC chip shown in FIG. 2 of Japanese unexamined patent publication No. Hei 11-15377. That is, as shown in FIG. 4, the IC tag 100 has a shape of a horizontally long rectangle that has a predetermined thickness, about 1 cm of the short side indicated by an arrow 121, and about 3 cm of the long side indicated by an arrow 122. In this example, the IC tag 100 further includes an information processing portion 101, a communication control portion 102, a power accumulation portion 103, an information storage portion 104, and an antenna 105, which are covered by a member 106 made of a water-repellent material such as PET. The information processing portion 101 of the IC tag 100 generally will, in response to an instruction from an outside, operate the program stored in the information storage portion 104 to perform operations such as addition of the data. The communication control portion 102 may communicate data with the outside. The power accumulation portion 103 may temporarily accumulate power supplied from the outside, to supply power necessary for the operation of the information processing portion 101. The information storage portion 104 may store data used in the information processing portion 101 and data which is input from the outside. The antenna 105 may transmit and receive radio waves in communication with the outside and receive power supply from the outside. It should be noted that the IC tag of the present disclosure is not limited to Example 1 described above. An IC tag equipped with an information storage portion with various kinds of stored information can be employed. The size of the IC tag may be mostly dependent on a size of the antenna 105 which may be determined by a wavelength of communication radio waves and a communication-enabled distance. That is, the longer the wavelength of the communication radio waves are and the communication-enabled distance is, the larger the antenna 105 may become. Therefore, the size of the IC tag is also not limited to that described above.

Figure 5:
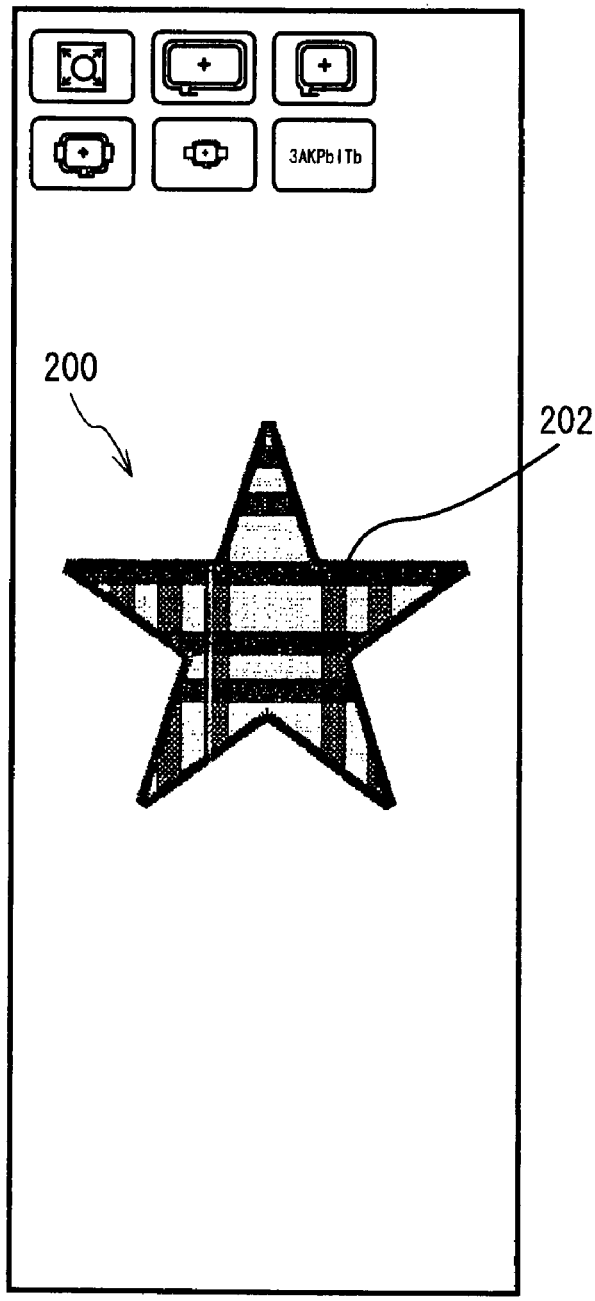
FIG. 5 is an explanatory diagram showing a finish of an applique pattern of Example 1.
Figure 6:
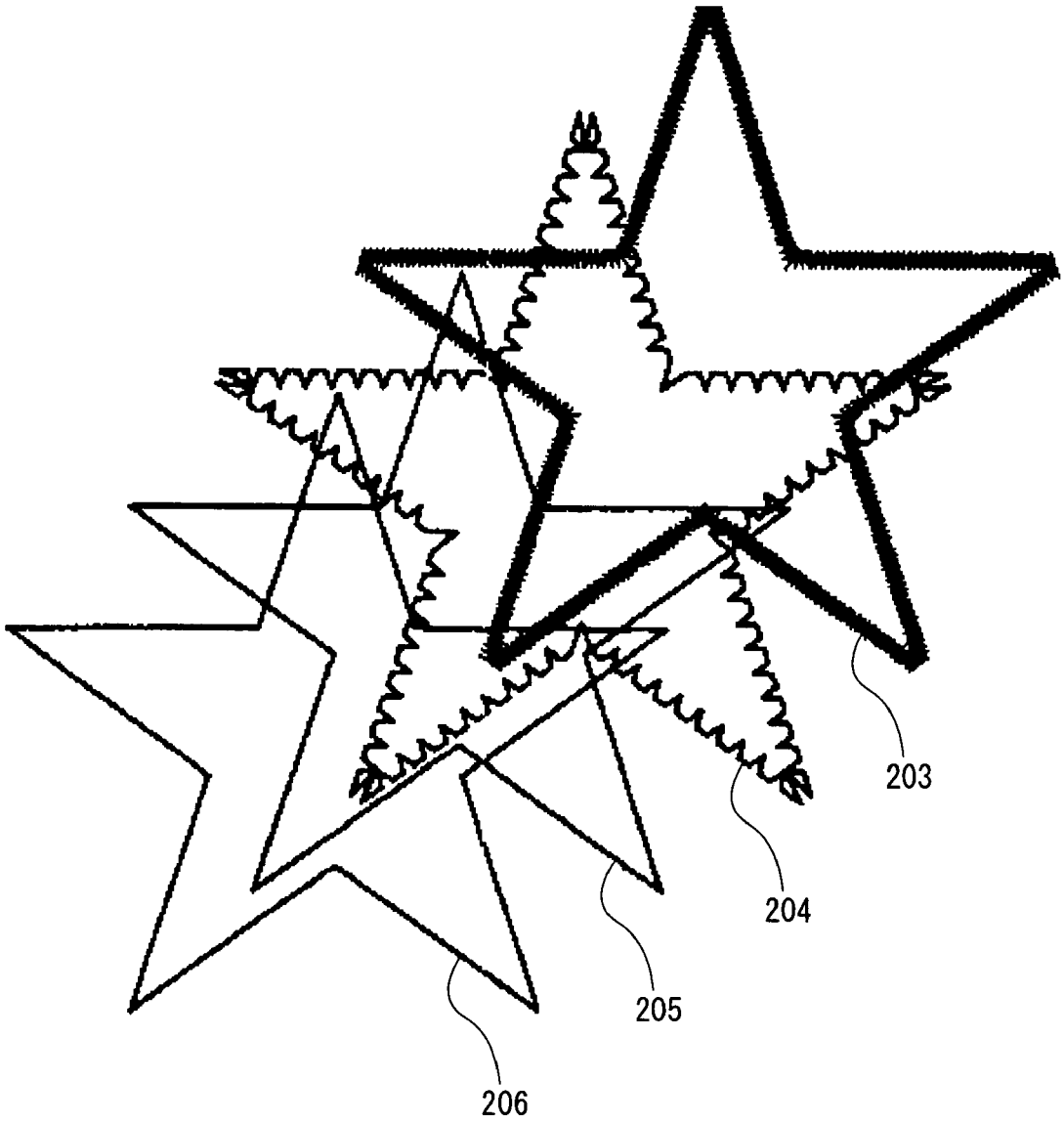
FIG. 6 is an explanatory diagram of stitches which are used to sew the applique of the example.
Figure 7:
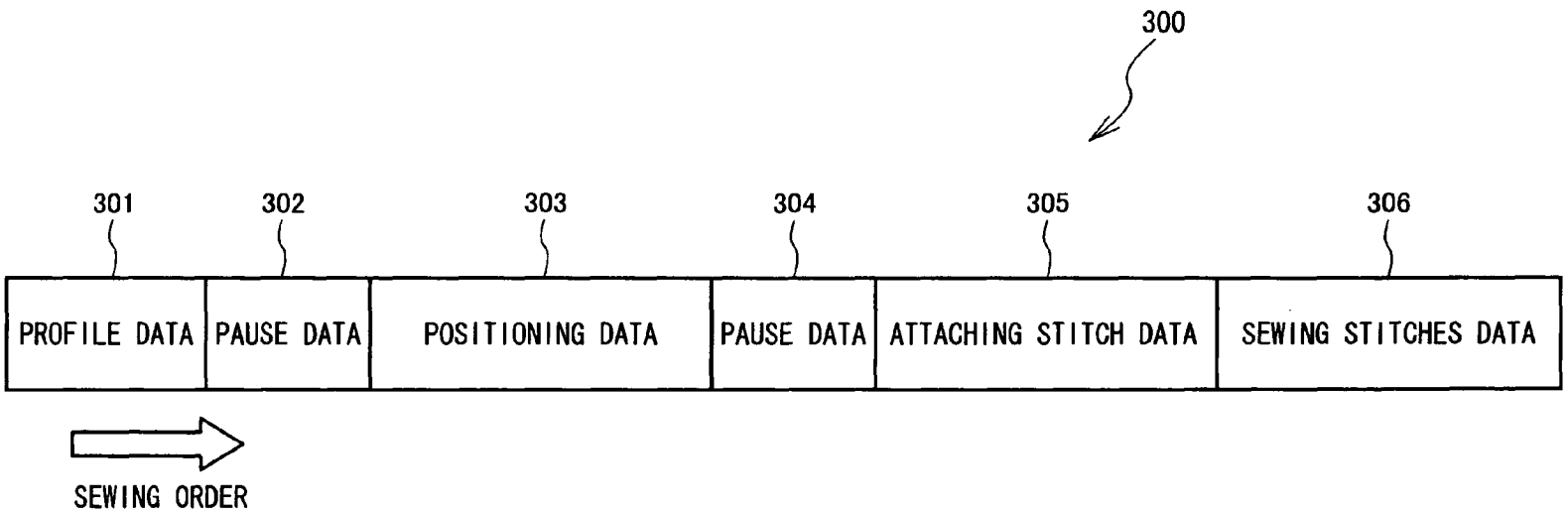
FIG. 7 is an explanatory diagram of applique pattern data which is used to sew the applique pattern of the example.

Next, the applique pattern 200 according to Example 1 and applique pattern data 300 used to sew the applique pattern 200 will be described below with reference to FIGS. 5 through 7. As shown in FIG. 5, the applique pattern 200 has been obtained by cutting off a star shape of a checkered cloth piece 202, in which vertical and horizontal lines intersect. The applique pattern data 300 used to sew the applique pattern 200 may include profile data 301, pause data 302, positioning data 303, pause data 304, attaching stitch data 305, and sewing stitches data 306 as shown in FIG. 7. The profile data 301 may be used to form applique cut-off stitches 206 on an applique cloth, which serve as a mark for cutting off a piece of applique cloth. The pause data 302 and 304 may be used to issue a command to suspend sewing performed by the sewing machine 1. The positioning data 303 may be used to form applique positioning stitches 205 on a fabric for positioning the cut off cloth piece which is to be pasted to the fabric. The attaching stitch data 305 may be used to form applique attaching stitches 204 to attach a cloth piece pasted to the fabric to the to work cloth. The sewing stitches data 306 may be used to form applique sewing stitches 203 for sewing a cloth piece to work cloth by using satin-sewing stitches.

Next, the main processing of one embodiment for setting positions of the IC tag area and the applique pattern area in a sewable area will be described with reference to FIGS. 8 through 15. In the first embodiment, it is determined whether the IC tag area can be located in an applique pattern area which is based on applique pattern data represented by relative coordinates of the positions set in the sewable area. If it is determined that the IC tag can be located in the safety area allocated in the applique pattern area, the applique pattern area and the IC tag can be located in the sewable area. Then, the position of the IC tag area relative to the applique pattern area may be set.

Figure 8:
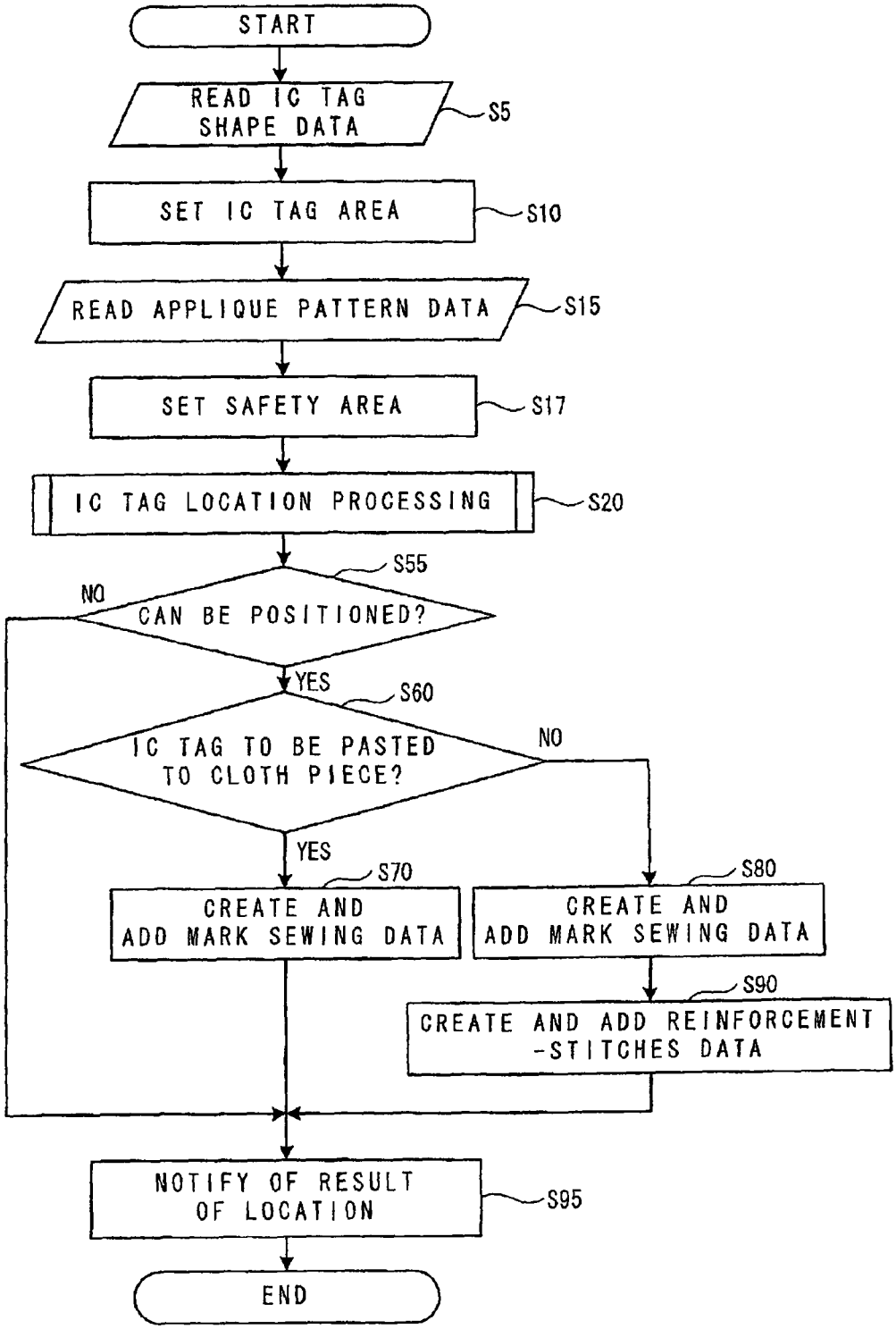
FIG. 8 is a flowchart illustrating a main processing of a first embodiment.
Figure 10:
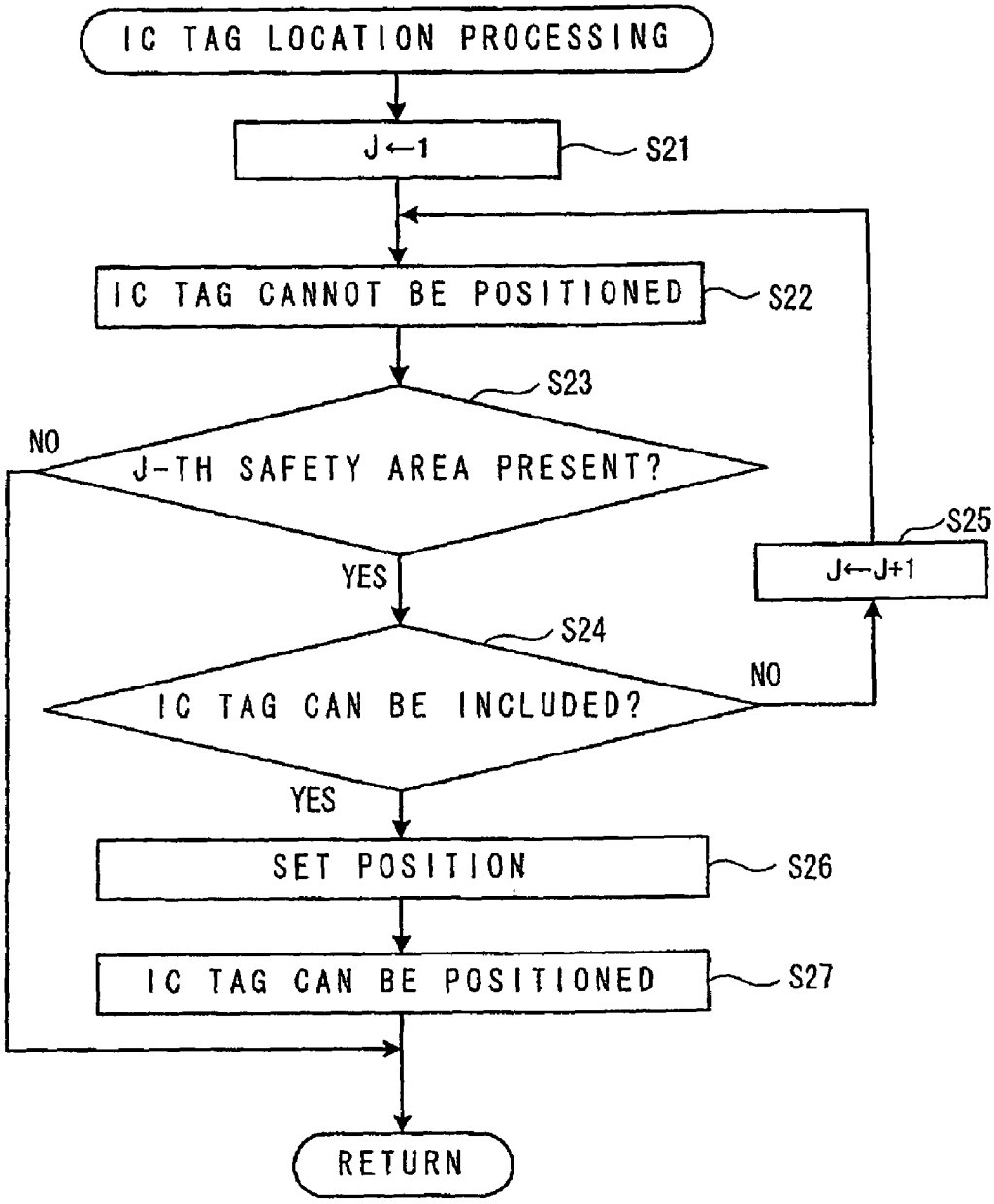
FIG. 10 is a flowchart illustrating an IC tag location processing which is performed in the main processing shown in FIG. 8.

A program that performs various processing shown in FIGS. 8 and 10 may be stored in the ROM 62 beforehand and executed by the CPU 61 shown in FIG. 2. Further, various kinds of information used to perform various processing shown in FIGS. 8 and 10 may be read from the ROM 62, the EEPROM 64, or the external storage device 39 and may be stored in a predetermined storage area in the RAM 63.

In the main processing shown in FIG. 8, first, the shape data of the IC tag 100 may be read and stored in the IC tag shape storage area 631 in the RAM 63 (S5). This processing may serve to determine the IC tag area based on the size and shape of the IC tag 100. For example, if the sewing machine 1 serving as the sewing data processing apparatus is equipped with a scanner or a sensor for reading the shape of the IC tag 100, the shape data of the IC tag 100 may be acquired by the scanner or sensor and read (S5). In the first embodiment, the image scanner sensor 27 may be used to acquire form information representing the size and shape of the IC tag 100 as the shape data, which may be stored in the IC tag shape storage area 631 in the RAM 63 (S5). In this Example, a horizontally long rectangle as the shape of the IC tag 100 as well as the lengths of the short side indicated by the arrow 121 and the long side indicated by the arrow 122 as the size of the IC tag 100 shown in FIG. 4 are acquired. By thus acquiring the shape data through the image scanner sensor 27 as described above, the IC tag area can be determined appropriately. The IC tag area may be used in processing of determining the positions of the applique pattern area and the IC tag area in such a manner that the IC tag is covered by an applique pattern.

Subsequently, the IC tag area based on the shape data of the IC tag read at S5 may be set and stored in the IC tag area storage area 632 in the RAM 63 (S10). An area of an outer periphery of a profile of the IC tag 100 shown in FIG. 4 plus a seam allowance indicated by an arrow 123 which is provided to sew the IC tag 100 to the work cloth, may be set as an IC tag area 131. Then, the IC tag area 131 may be stored in the IC tag area storage area 632 in the RAM 63 (S10). It should be noted that it is possible to arbitrarily set a width of the seam allowance to be added to the outer periphery of the profile of the IC tag 100. However, the seam allowance may be unnecessary in a case where the IC tag 100 is not sewn to the work cloth, for example.

Figure 9:
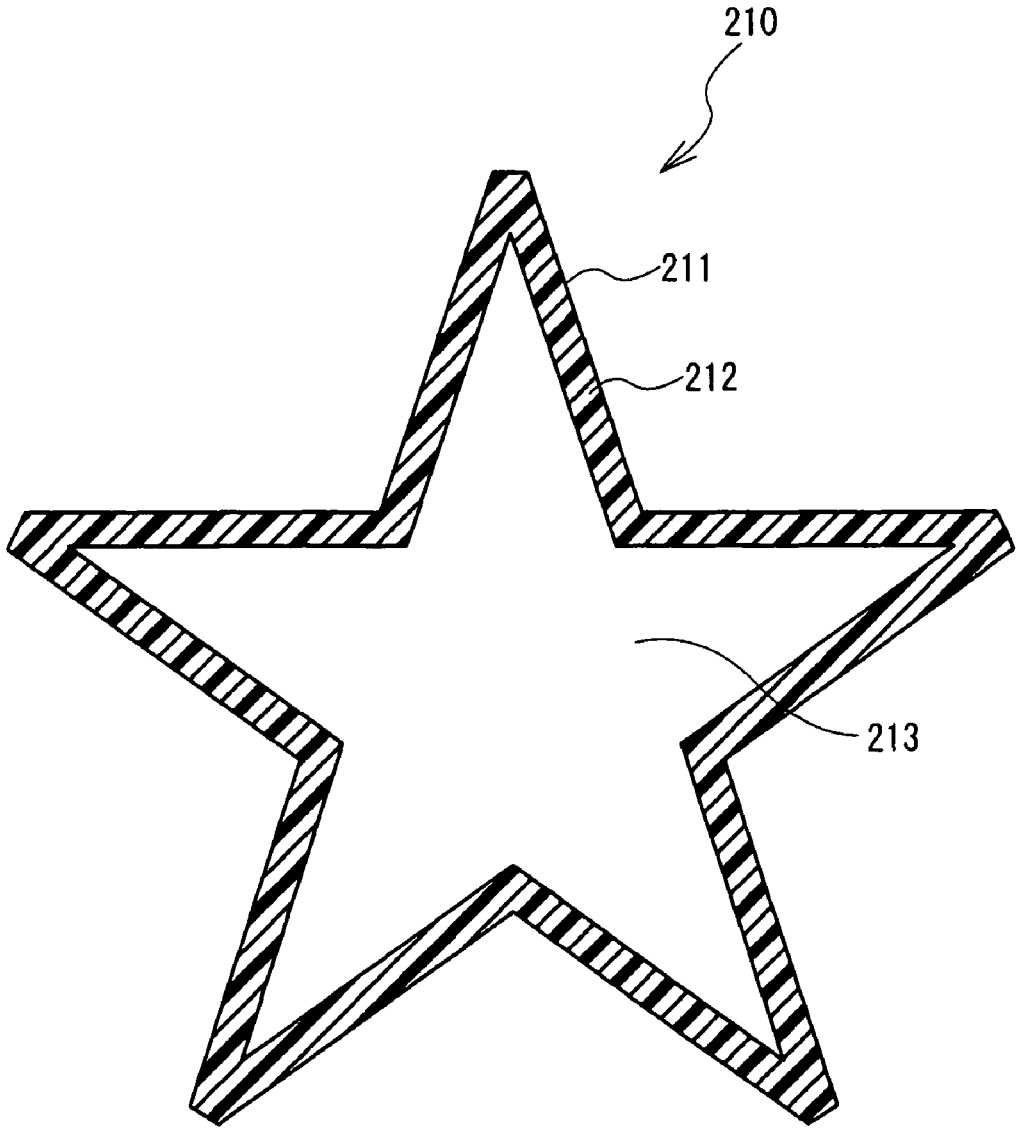
FIG. 9 is an explanatory diagram of a safety area which is set by the main processing shown in FIG. 8.

Next, the applique pattern data 300 stored in the ROM 62 or a storage area such as the external storage device 39 may be read and stored in the applique pattern data storage area 633 in the RAM 63 (S15). Subsequently, the applique pattern data storage area 633 may be referred to in order to determine the safety area in which the IC tag area can be located in the applique pattern area, based on the profile and seam allowance of the applique pattern as well as the shrinkage (estimated) of the work cloth and the cloth piece (S17). It should be noted that the profile of the applique pattern is generally determined on the basis of the applique pattern data. The seam allowance may be used when sewing the cloth piece on which the applique pattern is formed to the work cloth. This processing may be performed to prevent the IC tag area from being located in an area in which the applique attaching stitches 204 and the applique sewing stitches 203 shown in FIG. 6 are formed. This processing may be performed also to determine the IC tag area taking into account the shrinkage of the work cloth and the cloth piece. By such processing, the safety area 213 may be positioned inside the applique pattern area 210 of Example 1 as shown in FIG. 9 (S17). This safety area 213 may be positioned inside the applique pattern area 210 by a constant width of a sewing width W mm of the applique sewing stitches 203 plus $\alpha$ mm of the shrinkage of the work cloth and the cloth piece. It should be noted that hereinafter, an area hatched in FIG. 9 is referred to as an unsafe area 212 which is between the safety area 213 and an inside of the profile 211 where the applique attaching stitches 204 and the applique sewing stitches 203 are formed.

Subsequently, the IC tag location processing may be performed to position the IC tag area in the safety area set in the applique pattern area determined on the basis of the applique pattern data 300 (S20). This IC tag location processing will be described below with reference to a flowchart shown in FIG. 10.

Since the safety area set at S17 of FIG. 8 may be divided into a plurality of areas, in the first embodiment, the safety areas set at S17 may be read in sequence and whether the IC tag area can be included in each of the safety areas is determined. Therefore, in the IC tag location processing shown in FIG. 10, first "1" may be set to a safety area counter J, which may be used to read the safety areas set at S17 of FIG. 8 in sequence and stored in the safety area counter storage area 635 (S21). Subsequently, the IC tag location flag may be set to "0", which indicates that the IC tag area cannot be positioned in the applique pattern area. It should be noted that the IC tag location flag is generally used to determine whether the IC tag area can be positioned in the applique pattern area. Then, the IC tag location flag may be stored in the IC tag location flag storage area 636 (S22). Subsequently, the safety area storage area 634 and the safety area counter storage area 635 may be referred to in order to determine whether there is a J-TH safety area (S23). If having determined that there is no J-TH safety area (NO at S23), it may be determined that all the safety areas have been read. Therefore, the IC tag location processing is ended and the process may return to the main processing shown in FIG. 8.

On the other hand, in Example 1, as shown in FIG. 9, the applique pattern area 210 has one safety area 213, so that it may be determined that there is a first safety area 213 (YES at S23). Subsequently, the IC tag area storage area 632, the safety area storage area 634, and the safety area counter storage area 635 may be referred to in order to determine whether the IC tag area can be included in the J-TH safety area (S24). In the processing of the step S24, the safety area and the IC tag area may be repeatedly relocated to relatively different positions and, it can be calculated whether the IC tag area is included in the applique pattern area is determined upon each relocation. It should be noted that the relocation is generally performed on a predetermined condition that, for example, all of the locations should be combined. As a result, if having determined at least once that the IC tag area can be included in the safety area, it is determined that the IC tag area can possibly be included in the J-TH safety area. By such determination, whether the IC tag area may be included in the applique pattern area is securely determined. It should be noted that the predetermined condition can be defined arbitrarily; for example, aside from the above-described condition that all the locations should be combined, such a condition may be employed that the processing should end if the IC tag area is determined at least once that it can be included.

Figure 11:
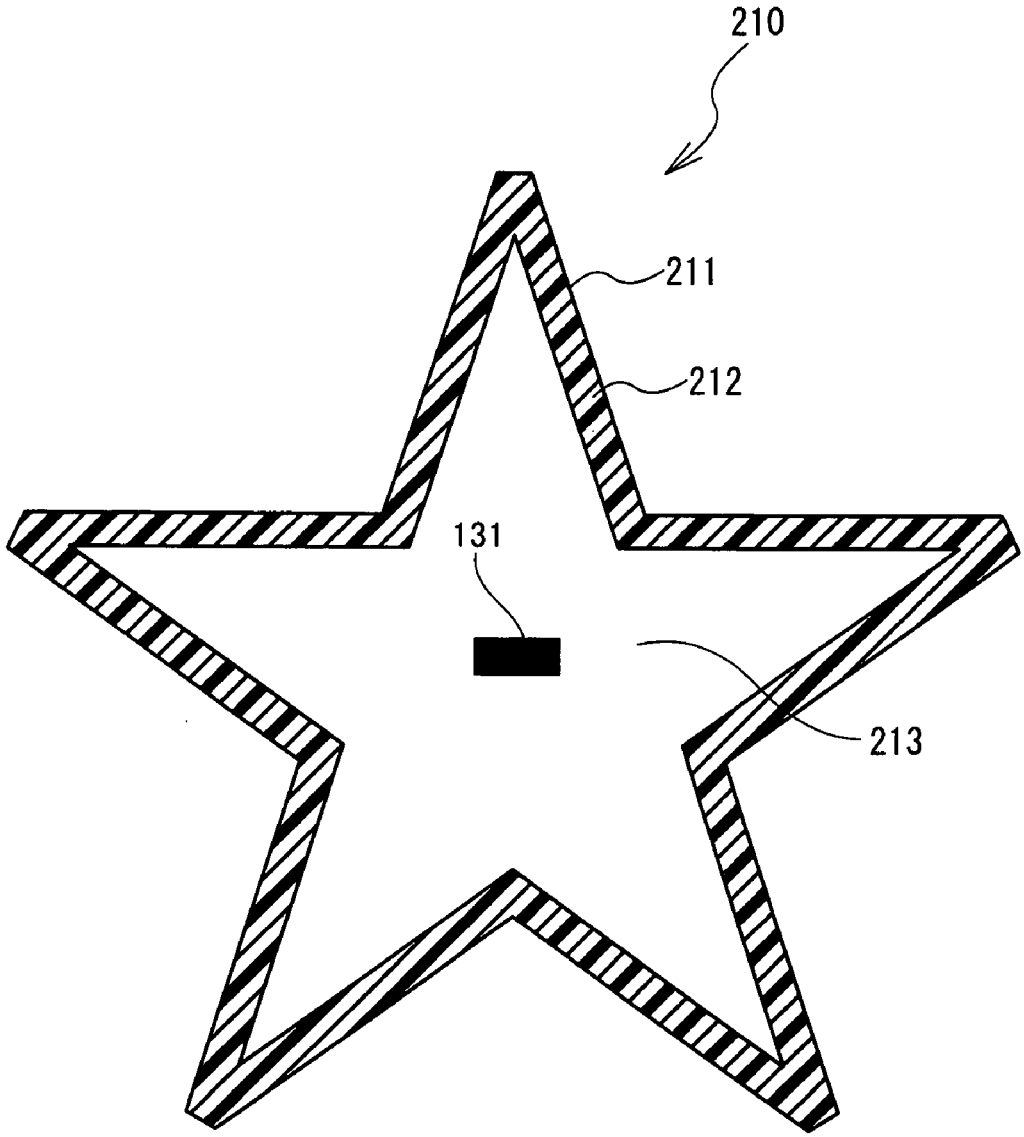
FIG. 11 is an explanatory illustration of an IC tag area whose position has been changed by the IC tag location processing shown in FIG. 10.

If having determined at S24 that the IC tag area cannot be included (NO at S24), to read the next safety area subsequently, the safety area counter J may be incremented by 1 (S25). Then, the safety area counter J may be stored in the safety area counter storage area 635. Then, the processing may be repeated from S22. On the other hand, in Example 1, as shown in FIG. 11, it is determined that the IC tag area 131 can be included in the safety area 213 (YES at S24). Subsequently, the position of the IC tag area relative to the applique pattern area 210 of the applique pattern 200 may be set as shown in FIG. 11 and stored in the IC tag area location storage area 637 (S26). As described above, if having determined that the IC tag can be positioned in the safety area, it may be judged that the applique pattern area and the IC tag area can be included in the sewable area. Therefore, in the processing the position of the applique pattern area 210 in the sewable area may be determined beforehand or the position of the applique pattern area 210 in the sewable area may be determined by the processing. Further, at the point in time, only the position of the IC tag area 131 relative to the applique pattern area 210 may be determined to determine the position of the applique pattern area 210 in the sewable area in the subsequent processing of sewing by use of the sewing machine 1 etc. Further, the position only needs to be set in such an aspect that the position to which the IC tag area is positioned can be determined. For example, in the case of the position to which the IC tag area is positioned by using an absolute position within the sewable area, coordinates may be set which represent an outer appearance of the IC tag area or coordinates of a center of the IC tag area may be set. Further, when setting the position to which the IC tag area is positioned by the position relative to the applique pattern area, relative coordinates may be set which represent the outer appearance of the IC tag area as viewed from a predetermined point in the applique pattern area or relative coordinates of the center of the IC tag area may be set. Subsequently, the IC tag location flag may be set to "1", which indicates that the IC tag area can be positioned in the applique pattern area, and stored in the IC tag location flag storage area 636 (S27). Subsequently, the IC tag location processing may be ended and the process returns to the main processing of FIG. 8.

Following S20 of FIG. 8, the IC tag location flag storage area 636 may be referred to in order to determine whether the IC tag area can be positioned in the safety area inside the applique pattern area (S55). If the IC tag location flag is stored as being 0, it is determined that the IC tag area cannot be positioned in the safety area set inside the applique pattern area (NO at S55). Then, the LCD 15 may give an indication to the effect that the IC tag area cannot be positioned in the safety area inside the applique pattern area (S95). By such processing, a user can confirm the result of the determination that the IC tag area cannot be positioned in the safety area inside the applique pattern area. Then, the main processing may end.

On the other hand, in a case where the IC tag location flag is stored as being "1" as in the case of Example 1, it is determined that the IC tag area can be positioned in the safety area 213 set in the applique pattern area 210 (YES at S55). Subsequently, whether to paste the IC tag to the cloth piece may be determined (S60). If the IC tag should be covered by an applique pattern, the IC tag may be pasted to the cloth piece or the IC tag may be positioned to the work cloth to which the cloth piece is sewn. Therefore, the processing confirms whether the IC tag is positioned on the cloth piece or the work cloth. Whether the IC tag is positioned on the cloth piece or the work cloth may be stored beforehand in the ROM 62 or the EEPROM 64 or, entered by the user each time.

Figure 12:
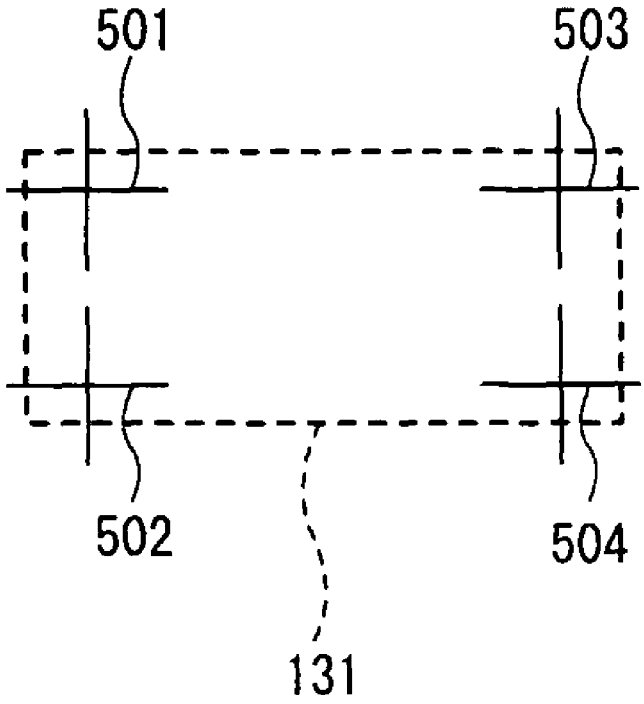
FIG. 12 is an explanatory diagram of mark sewing data which is used to form stitches that serve as a mark when positioning the IC tag on the work cloth.
Figure 13:
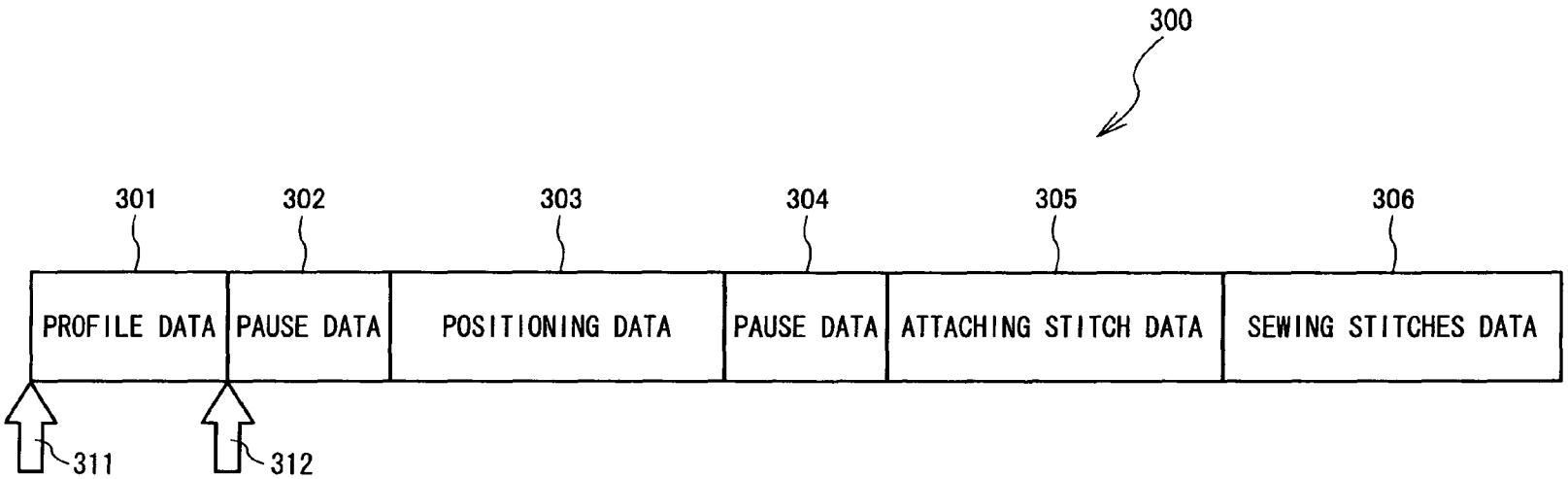
FIG. 13 is an explanatory diagram of positions to which the mark sewing data is added when the IC tag is attached to a cloth piece in the main processing shown in FIG. 8.

If having determined at S60 to paste the IC tag to the cloth piece (YES at S60), then, mark sewing data used to form stitches on the cloth piece that serves as a mark when locating the IC tag to the cloth piece may be created and added to the applique pattern data (S70). This mark sewing data only needs to serve as a mark when locating the IC tag and so may be, for example, sewing data used to form stitches that match the profile of the IC tag or mark sewing data used to form stitches that indicate the center of the IC tag. However, since the cloth piece is used to form an applique pattern thereon, the thread used to form the mark stitches may preferably be removed easily after the IC tag is positioned so that stitches due to the mark sewing data do not damage the outer appearances of the applique pattern. In Example 1, as the mark sewing data, as shown in FIG. 12 for example, such sewing data may be created to form stitches 501 through 504 on the crosses which have their intersection points inside the profile line of the IC tag area 131. The intersection points of the crosses of the stitches 501 through 504 indicate positions where vertexes of the IC tag 100 may be positioned respectively. Since the stitches 501 through 504 can be easily removed after the IC tag is positioned to the cloth piece, the stitches made by the mark sewing data do not damage the outer appearances of the applique pattern. As shown in FIG. 13, the mark sewing data may be added to a position, indicated by an arrow 311, immediately preceding the profile data 301 serving as sewing data which may come first in sewing order, or a position indicated by an arrow 312, immediately following the profile data 301 and stored in the applique pattern data storage area 633 (S70). By creating and adding the mark sewing data, it is possible to easily position the IC tag to the set position by using the stitches formed on the work cloth based on the mark sewing data as a mark. It should be noted that in the case of pasting the IC tag to the cloth piece, stitches are not generally formed on the cloth piece, so that processing of creating sewing data with which to sew the IC tag to the cloth piece is not typically performed.

Figure 14:
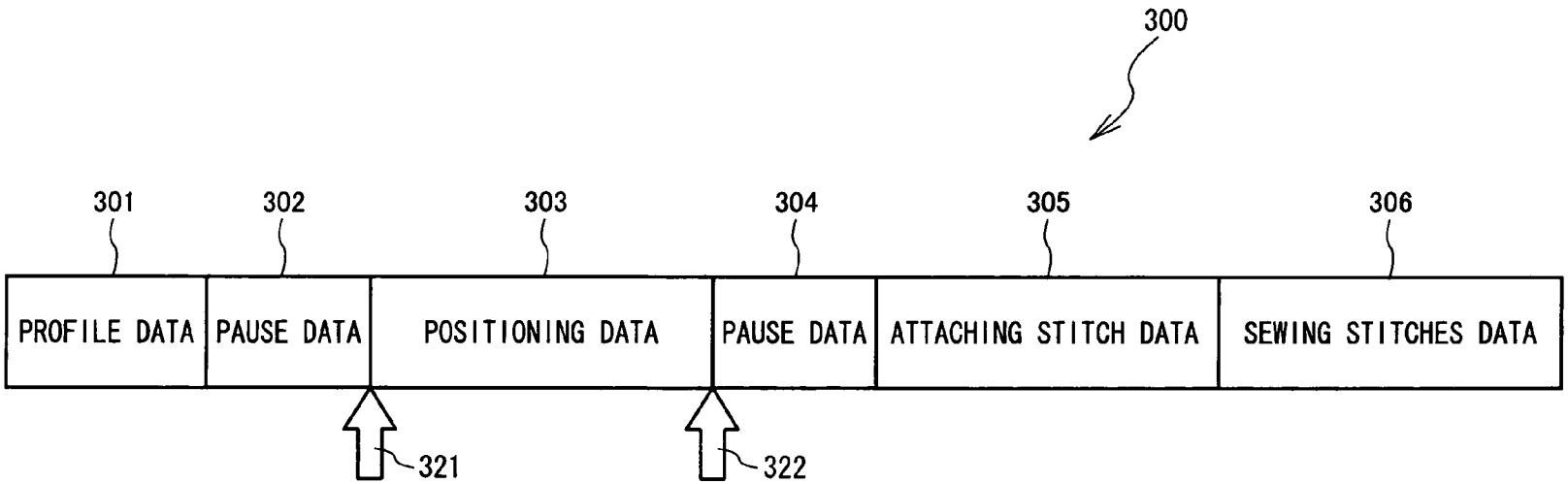
FIG. 14 is an explanatory diagram of positions to which the mark sewing data is added when the IC tag is attached to a work cloth in the main processing shown in FIG. 8.
Figure 15:
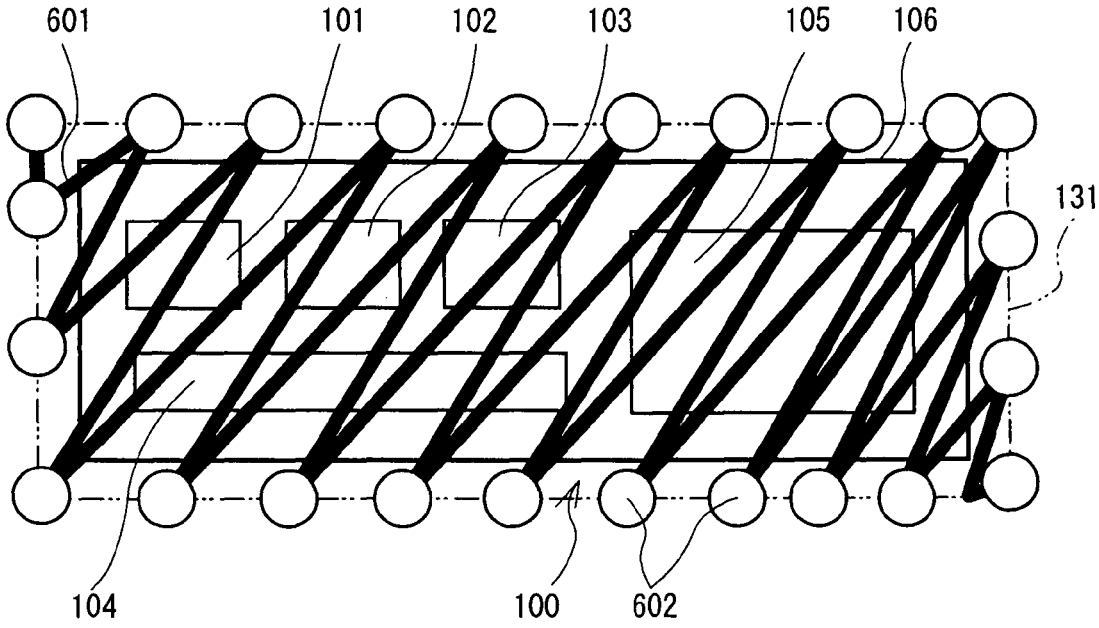
FIG. 15 is an explanatory diagram of reinforcement-stitches data which is used to form stitches when fixing the IC tag to the work cloth.

On the other hand, if having determined not to paste the IC tag to the cloth piece (NO at S60), subsequently, the mark sewing data used to form stitches on the work cloth that serves as a mark when locating the IC tag to the work cloth may be created and added to the applique pattern data (S80). As at S70, the mark sewing data only needs to serve as a mark when locating the IC tag. Since the applique pattern area on the work cloth is covered by the cloth piece, stitches made by the mark sewing data, if left, do not damage the outer appearances of the applique pattern. Therefore, in contrast to a case where the IC tag is pasted to the cloth piece, a thread used to form the mark stitches need not be removed easily, for example, in contrast to the above-described stitches 501 through 504 in FIG. 12. As shown in FIG. 14, the mark sewing data created at S80 may be added to a position, indicated by an arrow 321, immediately preceding the positioning data 303 which may come third in sewing order, or a position indicated by an arrow 322, immediately following the positioning data 303 and stored in the applique pattern data storage area 633 (S80). In Example 1, it is possible to add mark sewing data to an appropriate position in the applique sewing data (S70, S80) in accordance with whether to position the IC tag to the work cloth (NO at S60) or to the cloth piece (YES at S60).

Subsequently, reinforcement-stitches data used to sew the IC tag to the work cloth may be created and added to the applique pattern data (S90). Any stitches can be employed arbitrarily as far as they serve to sew the IC tag to the work cloth. In Example 1, as the reinforcement-stitches data, sewing data is created which has a needle drop point on the profile line of the IC tag area 131 such as a needle location 602, indicated by a circle in FIG. 15, used to sew the IC tag 100 to the work cloth. By thus running a thread 601 interconnecting the needle drop points 602 obliquely with respect to the IC tag 100 so that the IC tag 100 may be covered by the thread 601 from every direction, the IC tag 100 can be sewn securely to the work cloth. The thus created reinforcement-stitches data may be added to the position immediately before the attaching stitch data 305 such as shown in FIG. 14 and stored in the applique pattern data storage area 633 (S90).

Following S70 or S90, the positions of the IC tag area and the applique pattern area may be displayed on the LCD 15 (S95). The user can confirm the positions indicated on the LCD 15 and, in accordance with the positions, position the IC tag to the work cloth. Then, the main processing shown in FIG. 8 may end.

According to the sewing machine 1 equipped with the sewing data processing apparatus of the first embodiment described in detail above, it is possible to determine the positions of the applique pattern area and the IC tag area so that the area of the IC tag attached to the work cloth may be included in the safety area set in the applique pattern area. Therefore, in accordance with the positions of the applique pattern area and the IC tag area determined by the sewing machine 1 equipped with the sewing data processing apparatus of the first embodiment, the IC tag attached to the work cloth can be covered by an applique pattern and the IC tag capable of storing a lot of information can be attached to the work cloth without damaging the design.

Further, according to the present sewing machine 1, the safety area may be determined taking into account the profile of the applique pattern, the seam allowance used to sew the cloth piece to the work cloth, and the shrinkages of the work cloth and the cloth piece. It is thus possible to prevent the applique attaching stitches 204 and the applique sewing stitches 203 formed on the basis of the applique pattern data from being positioned in the IC tag area set inside the safety area.

Further, in the present sewing machine 1, relocation of the applique pattern area and the IC tag area once located to the sewable area at S24 shown in FIG. 10 to relatively different positions may be repeated until predetermined conditions are satisfied. Each time doing so, whether the IC tag area is included in the safety area of the applique pattern area may be determined. If having determined at least once that it can be included, the IC tag area may be determined to be able to be included in the applique pattern area determined on the basis of the applique pattern data. It is thus possible to securely determine whether the IC tag area can be included in the safety area set in an applique pattern area.

Further, the image scanner sensor 27 may acquire, as outline data, form information that may represent the size and shape of the IC tag to be mounted to the work cloth, and the IC tag area may be determined based on this data. Therefore, the IC tag area which may be used to determine positions to which the applique pattern area and the IC tag area are positioned may be appropriately determined in such a manner that the IC tag may be covered by the applique pattern.

Further, mark sewing data may be created which is used to form the stitches 501 through 504 that serve as a mark when locating the IC tag 100 on the cloth piece or the work cloth. The mark sewing data can thus be added to an appropriate position in the applique pattern data (S70, 80) in accordance with whether the IC tag is positioned to the work cloth (NO at S60) or to the cloth piece (YES at S60). If it is determined in the main processing that the IC tag should be positioned on the work cloth (NO at S60), further, reinforcement-stitches data can be created which may be used to form stitches with which to sew the IC tag positioned at the appropriate position to the work cloth by using as a mark the stitches 501 through 504 formed on the basis of the mark sewing data. The IC tag can thus be fixed securely on the work cloth.

The sewing machine 1 equipped with the sewing data processing apparatus of the first embodiment may further include the LCD 15 that notifies of the result of the determination that the applique pattern area has no area to include the IC tag area and the positions of the applique pattern area and the IC tag area. Therefore, if the result of the determination in the case where the applique pattern area has no area to include the IC tag area is indicated on the LCD 15, the user can know whether any area is available in which the IC tag area can be included. Further, if the positions of the applique pattern area and the IC tag area are indicated on the LCD 15, the IC tag can be positioned to the work cloth or the cloth piece in accordance with the indicated positions and the IC tag may be covered by the applique pattern.

It should be noted that the present disclosure is not limited to the above-described embodiment described in detail above and can be changed in a variety of manners without departing from the spirit and scope of this disclosure, as characterized in the appended claims.

Although the first embodiment has been described first with reference to the case where the sewing data processing apparatus has been integrated with the sewing machine 1, it is not limited to this configuration, and the sewing data processing apparatus may be separated from the sewing machine 1. Further, although the first embodiment has been described with reference to the case where the present disclosure has been applied to the sewing machine 1 equipped with one needle bar, the present disclosure may be applied to a multi-needle type sewing machine that is equipped with a plurality of needle bars.

Further, in the first embodiment, at S5 of FIG. 8, shape data is acquired through the image scanner sensor 27 as form information that may represent the size and shape of the IC tag 100 and stored in the IC tag shape storage area 631 in the RAM 63 (S5). However, the means of acquiring the IC tag form information is not limited to this method. For example, in a case where shape data of the IC tag 100 is stored beforehand in the ROM 62 or the external storage device 39 etc., the storage areas may be referred to at S5 to read the shape data of the IC tag 100 and may be stored in the IC tag shape storage area 631 in the RAM 63 (S5). Further, in a case where an IC tag area determined on the basis of the shape data of the IC tag is stored beforehand in the ROM 62 or the external storage device 39 etc., the storage areas may be referred to at S5. Then, the IC tag area for the IC tag 100 may be read and stored in the IC tag area storage area 631 in the RAM 63 (S5), thus the subsequent processing of S10 may be omitted. Further, for example, if the shape data of the IC tag is stored together with a predetermined ID in the ROM 62 or the external storage device 39 etc. beforehand and the ID is specified by the user, their storage areas may be referred to. Then, shape data of the IC tag 100 corresponding to the specified ID may be read and stored in the IC tag shape storage area 631 in the RAM 63 (S5). It should be noted that, for the shape data of the IC tag 100, the IC tag area and the ID, the one stored in a server on the network may be read by configuring the sewing machine 1 to enable the connection with the network such as the internet, instead of being stored beforehand in the ROM 62 or the external storage device 39.

Further, for example, if the shape of an IC tag is entered through the touch panel 26, the entered shape data may be read and stored in the IC tag shape storage area 631 in the RAM 63 (S5). It should be noted that the touch panel 26 may be replaced with any one of various switches, a trackball, or a joystick on a game controller that interfaces with the user.

Further, in the first embodiment, a safety area has been set in an applique pattern at S17 taking into account the profile of the applique pattern, the seam allowance used when sewing the cloth piece to the work cloth, and the shrinkage of the work cloth and the cloth piece. However, the safety area may be determined taking into account either one of the seam allowance used when sewing the cloth piece to the work cloth and the shrinkage of the work cloth and the cloth piece. Further, if a safety area need not be determined because, for example, the cloth piece to form the applique pattern is pasted to the work cloth with an adhesive or pressure-sensitive adhesive agent, the IC tag area may be positioned in such a manner as to be included in the applique pattern instead of determining the safety area.

Further, in the first embodiment, mark sewing data used to form stitches that serve as a mark when locating the IC tag on the cloth piece or work cloth has been created and added to applique pattern data at S70 or S80. However, for example, this processing may be omitted if such stitches need not be formed when locating the IC tag on the work cloth based on the positions notified at S95.

Further, in the first embodiment, reinforcement-stitches data used to sew the IC tag to the work cloth has been created and added to applique pattern data at S95. However, for example, this processing may be omitted if the IC tag need not be sewn to the work cloth because, for example, the IC tag is fixed to the work cloth with an adhesive or pressure-sensitive adhesive agent.

Further, in the first embodiment, when locating the IC tag on the cloth piece, the IC tag is assumed to be pasted at the position on the cloth piece set at S20, and when locating the IC tag on the work cloth, the IC tag is assumed to be sewn at the position on the work cloth set at S20. However, the present disclosure is not limited to the case of the present embodiment as far as the IC tag is positioned at the set position. Therefore, for example, a pocket in which to put the IC tag may be sewn to the applique pattern area on the work cloth. Further, similarly, the pocket in which to put the IC tag may be pasted to the applique pattern area on the cloth piece. In the case, the processing of S70 or S80 may be replaced by creating sewing data used to form stitches that indicate the position to which the pocket is positioned or the processing of S90 may be replaced by creating data used to sew the pocket to the work cloth.

Further, in the first embodiment, if having determined that it is impossible to position the IC tag in the applique pattern area (NO at S55), the result of the determination may be displayed on the LCD 15 at S95. On the other hand, if having determined that it is possible to position the IC tag in the applique pattern area (YES at S55), the set location of the IC tag area and the applique pattern area may be displayed on the LCD 15. However, this processing may be omitted if such information need not be indicated. Further, in the first embodiment, the LCD 15 has been used. However, the present disclosure is not limited to the use of LCD displays; any other display device such as a plasma display or an audio device that uses a voice notification such as a speaker may be employed instead.

As described above, in the first embodiment, it has been determined whether the IC tag area can be positioned in the applique pattern area represented by relative coordinates when positioned in a sewable area. If having determined that the IC tag area can be positioned in the applique pattern area, it is determined that the applique pattern area and the IC tag area can be positioned in the sewable area. However, in a second embodiment to be described next, a position on a work cloth to which an IC tag area is to be positioned may be determined in advance so that it may then be determined whether the IC tag positioned on that position can be covered by an applique pattern. The following will describe processing to determine beforehand the position on the work cloth to which the IC tag is to be positioned and set an applique pattern area so that the IC tag positioned on that position may be covered by the applique pattern with reference to Example 1 described above, along with FIGS. 16 through 19. It should be noted that programs to perform processing pieces shown in FIGS. 16 and 17 respectively may be stored in the ROM 62 beforehand and executed by the CPU 61 shown in FIG. 2. Further, various kinds of information used to perform the processing pieces shown in FIGS. 16 and 17 are generally read from the ROM 62, the EEPROM 64, or the external storage device 39 and may be stored in a predetermined storage area in the RAM 63.

A physical form and an electrical form of a sewing machine in the second embodiment are the same as those of the first embodiment except for storage areas of a RAM 63, so that description of the same configuration is omitted. Instead, the storage areas of the RAM 63 having a different configuration from those of the first embodiment will be described below. In addition to the storage areas of the RAM 63 of the first embodiment, the RAM 63 of the second embodiment may include an applique pattern area location storage area (not shown), which may store a location of an applique pattern area inside a sewable area.

Figure 16:
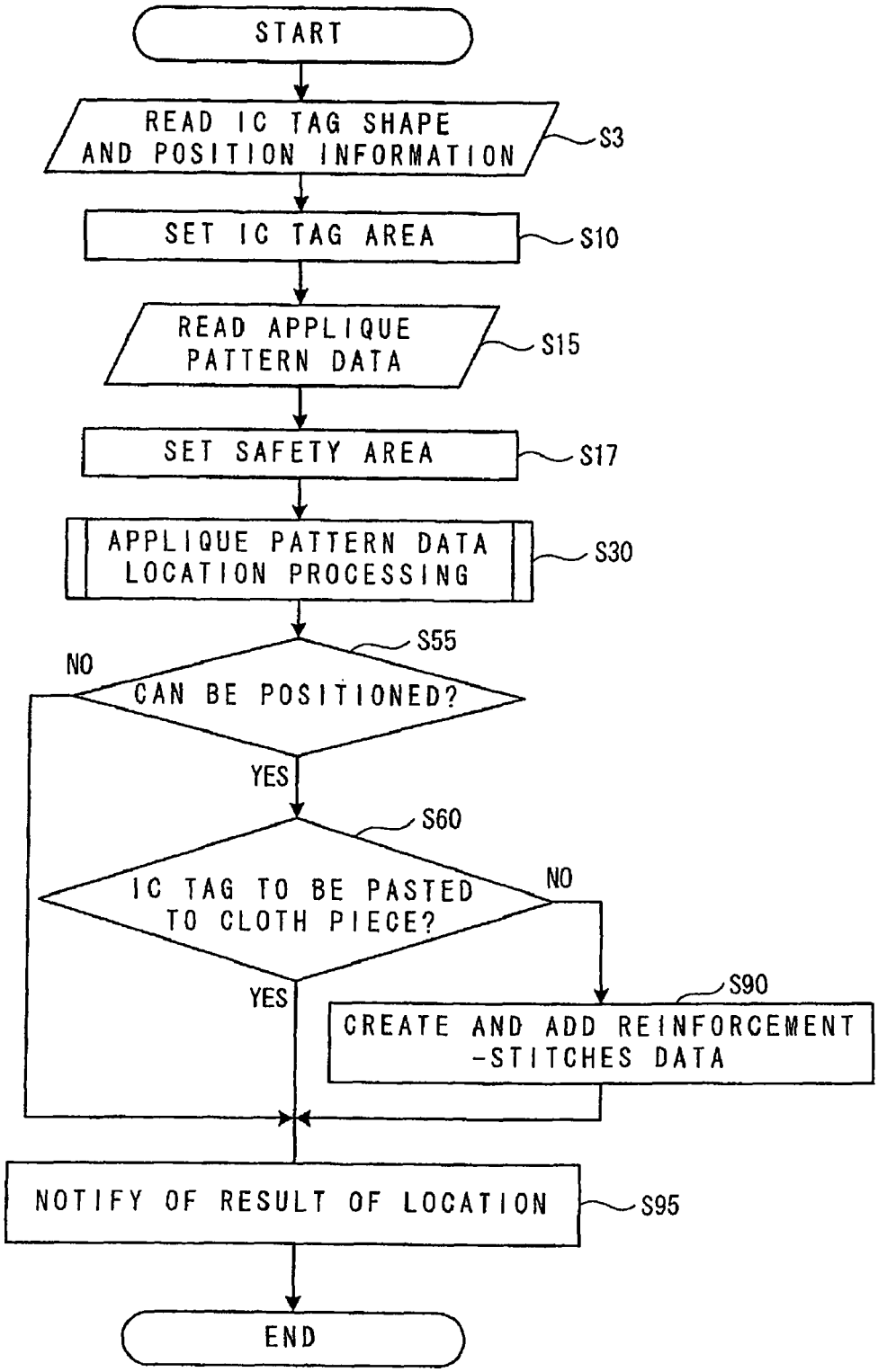
FIG. 16 is a flowchart illustrating a main processing of a second embodiment.
Figure 17:
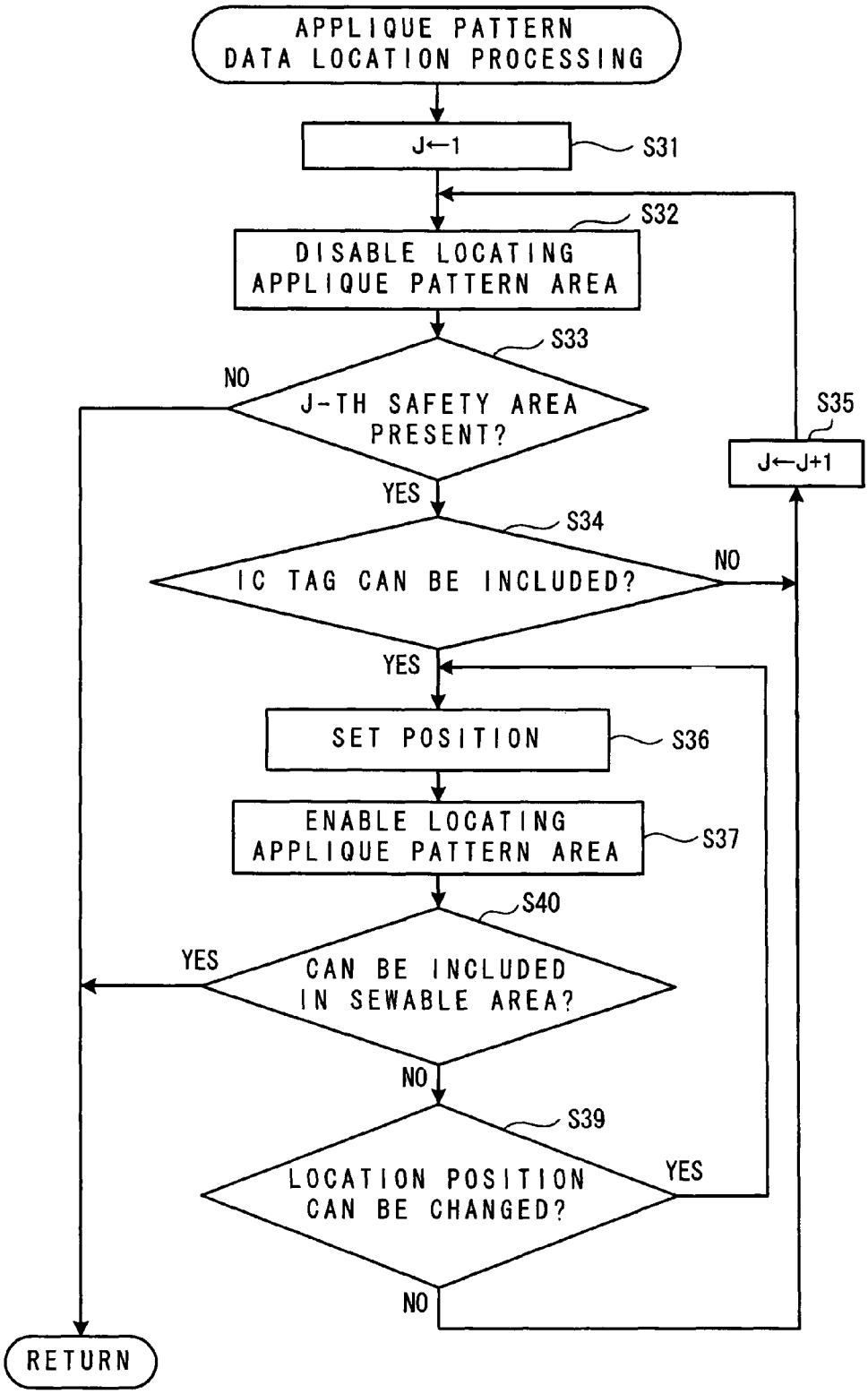
FIG. 17 is a flowchart illustrating applique pattern data location processing which is performed in the main processing shown in FIG. 16.

Main processing of a second embodiment shown in FIG. 16 is different from the main processing of the first embodiment shown in FIG. 8 in that the main processing of the second embodiment does not perform processing of steps S5, S20, S70, and S80 but does perform processing pieces of S3 and S30 of the main processing of the first embodiment. In the following description, the processing steps common to the main processing of the first embodiment will be omitted, to describe in detail steps S3 and S30 which are not generally performed in the main processing of the first embodiment shown in FIG. 8.

First, at S3 of FIG. 16, the process may read shape data of an IC tag 100 and position information of a work cloth. The shape data of the IC tag 100 may be stored in an IC tag shape storage area 631 and the position information of the work cloth for the IC tag 100 may be stored in an IC tag area location storage area 637 in the RAM 63 (S3). This processing may be performed in order to determine an IC tag area based on the size and shape of the IC tag 100 and acquire the position on the work cloth to which the IC tag is positioned. In the second embodiment, form information that represents the size and shape of the IC tag 100 may be acquired from an image scanner sensor 27 as shape data and may be stored in the IC tag shape storage area 631 in the RAM 63 (S3). Simultaneously, information of the position of the IC tag 100 on the work cloth may be acquired from the image scanner sensor 27 and may be stored in the IC tag area location storage area 637 (S3). Through such processing, the position of the IC tag in Example 1 is assumed to have been acquired such as an IC tag area 131 in a sewable area 651 shown in FIG. 18.

Next, applique pattern data location processing which is performed at S30 of FIG. 16 will be described with reference to FIGS. 17 through 19. The applique pattern data location processing shown in FIG. 17, which may be used as an alternative to the IC tag location processing (S20) shown in FIG. 8, accompanies processing to fixedly position an IC tag area to a position indicated by the position information acquired at S3 so that an applique pattern area may be set in the sewable area.

In the applique pattern data location processing shown in FIG. 17, first, "1" may be set to a safety area counter J, which may be used to read the safety areas in sequence, and the safety area counter J may be stored in a safety area counter storage area 635 (S31). Subsequently, the IC tag location flag may be set to "0" indicating that the IC tag area cannot be positioned in the applique pattern area. Then, the flag may be stored in an IC tag location flag storage area 636 (S32). Subsequently, an applique pattern data storage area 633 and the safety area counter storage area 635 may be referred to in order to determine whether there is a J-TH safety area (S33). If having determined that there is no J-TH safety area (NO at S33), it may be determined that all the safety areas have been determined on whether the IC tag area is included and the applique pattern data location processing may end. Then, the process may return to the main processing shown in FIG. 16.

On the other hand, if there is a safety area 213, such as an applique pattern area 210 of Example 1, it may be determined that there is a first safety area (YES at S33). Subsequently, the IC tag area storage area 632, a safety area storage area 634, and the safety area counter storage area 635 may be referred to in order to determine whether the IC tag area can be included in the J-TH safety area (S34). In this processing, relocation of the J-TH safety area to a relatively different position may be repeated in a condition where the IC tag area is fixed, and at each relocation, it may be determined whether the IC tag area is included in the applique pattern area. It should be noted that relocation is generally performed on such a predetermined condition that, for example, all of the locations may be combined and checked. As a result, if having determined at least once that the IC tag area is already included in the J-TH safety area, it may be determined that the IC tag area can be included in a safety area set in applique pattern data. If having determined that the IC tag area cannot be included in the safety area set in the applique pattern area (NO at S34), to read the next safety area subsequently, the safety area counter J may be incremented by 1 (S35). Then, the safety area counter J may be stored in the safety area counter storage area 635, to repeat the processing from S32.

Figure 18:
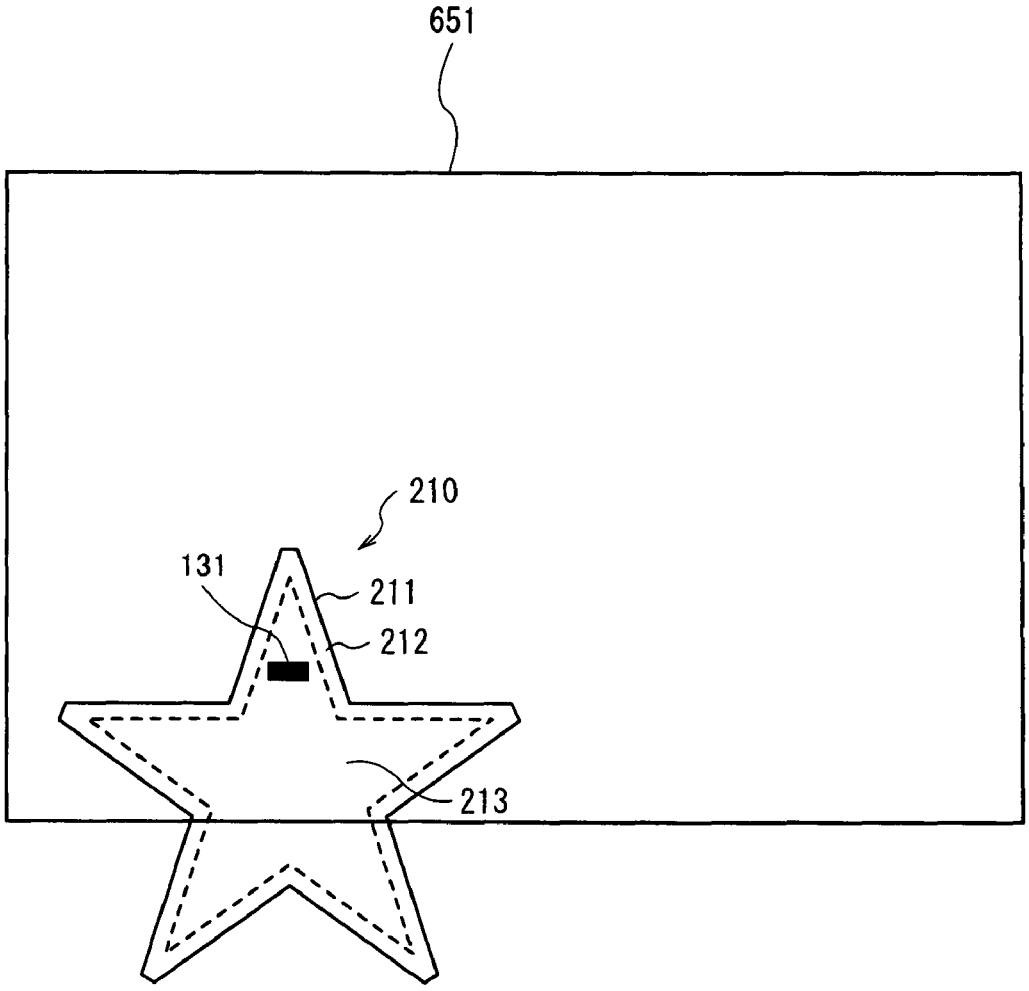
FIG. 18 is an explanatory diagram of a case where an applique pattern area is positioned outside a sewable area by the applique pattern data location processing shown in FIG. 17.

On the other hand, if having determined that the IC tag area 131 positioned as in Example 1 shown in FIG. 18 can be included in the safety area 213 of the applique pattern area 210, it may be determined that the IC tag area can be positioned in the first safety area 213 (YES at S34). Subsequently, a location of the applique pattern area 210 maybe set as shown in FIG. 18 and stored in an applique pattern area location storage area (not shown) (S36). Subsequently, the IC tag location flag may be set to "1", which indicates that the IC tag area can be positioned in the applique pattern area, and may be stored in the IC tag location flag storage area 636 (S37).

Subsequently, the applique pattern area location storage area (not shown) may be referred to in order to determine whether the applique pattern area is included in the sewable area (S40). This processing may be performed in order to position the applique pattern area in the sewable area. If the applique pattern area 210 of Example 1 is positioned as shown in FIG. 18, the applique pattern area 210 is partially outside the sewable area 651, it may be determined that the applique pattern area 210 is not included in the sewable area 651 (NO at S40). In the case, the position of the applique pattern area 210 should be changed, so that subsequently whether a position of the IC tag area can be changed in the J-TH safety area may be determined (S39). If having determined that the position of the IC tag area cannot be changed (NO at S39), to read the next safety area, the safety area counter J may be incremented by 1 (S35). Then, the safety area counter J may be stored in the safety area counter storage area 635, to repeat the processing from S32.

Figure 19:
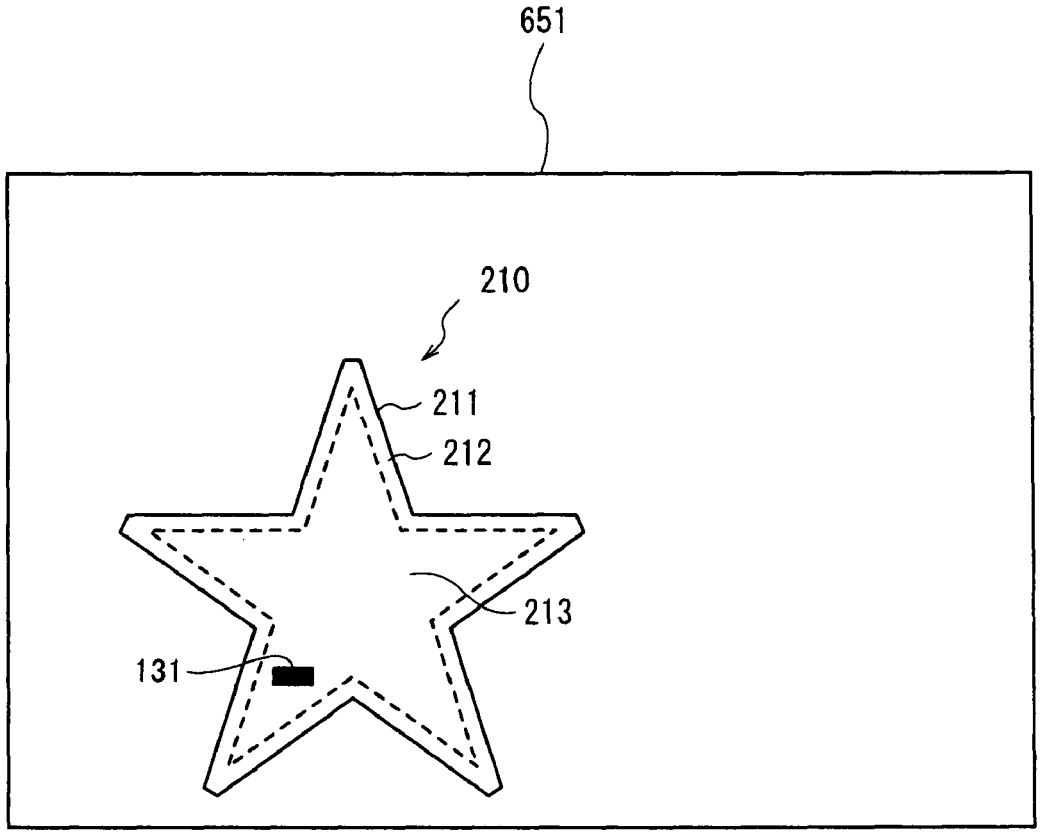
FIG. 19 is an explanatory diagram of a case where an applique pattern area is positioned within a sewable area by the applique pattern data location processing shown in FIG. 17.

On the other hand, in the example shown in FIG. 18, it may be determined that the position can be changed (YES at S39) and the applique pattern area 210 may be relocated to a position different from that in FIG. 18 so that the IC tag area 131 may be included in the first safety area 213 as shown, for example, in FIG. 19 (S36). Subsequently, the IC tag location flag may be set to "1", which may indicate that the IC tag area can be positioned in the applique pattern area, and the IC tag location flag may be stored in the IC tag location flag storage area 636 (S37). Subsequently, the applique pattern area location storage area (not shown) may be referred to in order to determine that the applique pattern area 210 is included in the sewable area 651 shown in FIG. 19 (YES at S40). In the case, it may be determined that the applique pattern area 210 need not be set again so that the process subsequently may end the applique pattern data location processing and may return to the main processing of FIG. 16.

As described in detail above, according to a sewing machine 1 equipped with a sewing data processing apparatus of the second embodiment, whether the applique pattern area can be positioned in the sewable area is determined in a condition where the position of the IC tag on work cloth may be fixed and then the applique pattern area may be positioned (S30). It should be noted that in the second embodiment, the location of the IC tag may be fixed, so that in contrast to the first embodiment, the main processing shown in FIG. 16 does not need to accompany the processing (of S70 or S80 of FIG. 8) to create and add mark sewing data used to form stitches that serve as a mark when locating the IC tag to the work cloth.

According to the second embodiment detailed above, it is possible to acquire position information indicating the position on the work cloth to which the IC tag 100 may be positioned and fix the position of the IC tag on the work cloth and then determine the location of an applique pattern 200 so that the IC tag 100 attached to the work cloth may be covered by the applique pattern 200. Therefore, in a case where the position on work cloth to which an IC tag is positioned is already set, it is possible to set the position of the applique pattern that matches the position of the IC tag in accordance with the positions of the applique pattern area 210 and the IC tag area which may be set by the sewing data processing apparatus of the present disclosure.

It should be noted that the present disclosure is not limited to the second embodiment described in detail above and can be changed in a variety of manners without departing from the spirit and scope of the present disclosure, as characterized in the appended claims. For example, although the second embodiment may acquire the position information of the IC tag through the image scanner sensor 27 at S3 of FIG. 16, the present disclosure is not limited to this configuration; for example, the position information of the IC tag may be entered by a user. Further, the second embodiment has not performed the processing to create and add mark sewing data used to form stitches that may serve as a mark when locating the IC tag on the work cloth. However, if it is desired to form the stitches that serve as the mark because, for example, the location of the IC tag has been shifted after the position information is acquired or the position information of the IC tag is entered by hand, the processing to create and add the mark sewing data may be performed.

Further, the second embodiment has acquired the position information of the IC tag at S3 of FIG. 16 to fix the IC tag area to the position indicated by the position information and then positioned the IC tag area in an applique pattern area. However, the present disclosure is not limited to this, so that the position information of the IC tag area and the applique pattern area may be acquired to fix the IC tag area and the applique pattern area to positions indicated by the position information, and then whether the IC tag area is included in the applique pattern area may be determined. In this case, for example, the user may be prompted to enter the position information of the IC tag as well as the position information used when locating the applique pattern so that the process may determine whether an IC tag area positioned to a position specified by the user is included in the applique pattern area positioned to a specified position. If having determined that the IC tag area is included, the applique pattern area and the IC tag area may be set to the specified positions in a sewable area of the sewing machine 1. It should be noted that a touch panel 26 may be replaced with any one of various switches such as a trackball, or a joystick on a game controller that interfaces with the user.

In the above-described first and second embodiments, whether an IC tag area can be positioned in the applique pattern area may be determined and the applique pattern area and the IC tag area may be set automatically. However, as in a third embodiment to be described next, a position in an applique pattern area to which an IC tag area is positioned may be selected by the user. The following will describe the processing where the user may select the position in the applique pattern area to which the IC tag is positioned by using a sewing machine 1 equipped with a sewing data processing apparatus of the third embodiment, with reference to FIGS. 20 through 25. As a specific example for describing the processing of the third embodiment, the IC tag area may be set in a figure-eight-shaped applique pattern area 600 shown in FIG. 20. It should be noted that programs to perform various processing pieces shown in FIGS. 21 through 23 respectively may be stored in an ROM 62 beforehand and executed by a CPU 61 shown in FIG. 2. Further, various kinds of information used to perform the processing pieces shown in FIGS. 21 through 23 may be read from the ROM 62, an EEPROM 64, or an external storage device 39 and may be stored in a predetermined storage area in the RAM 63.

A physical configuration and an electrical configuration of the sewing machine 1 equipped with a sewing data processing apparatus in the third embodiment are the same as those of the first embodiment except for storage areas of a RAM 63, so that description of the same constitution with the first embodiment is omitted and, instead, the storage areas of the RAM 63 which are configured differently from those of the first embodiment are described below. In addition to the storage areas of the RAM 63 of the first embodiment, the RAM 63 of the third embodiment may include safety area candidate counter storage area (not shown) and an includable area storage area (not shown). The safety area candidate counter storage area may be used to store a safety candidate counter which may count safety area candidates. The includable area storage area may be used to store an includable area, which will be described later.

Figure 20:
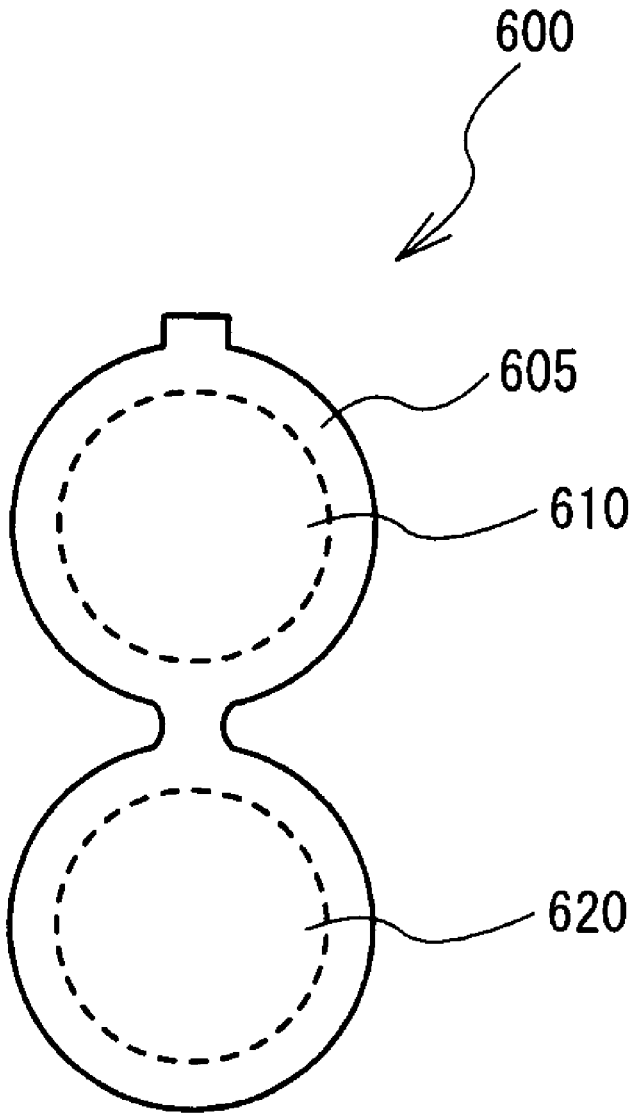
FIG. 20 is an explanatory diagram of an applique pattern area of Example 2.

First, an applique pattern area 600 for an applique pattern of Example 2 will be described with reference to FIG. 20. The applique pattern area 600 for the applique pattern of Example 2 generally has a figure-eight-shaped profile. Further, in the applique pattern area 600, safety areas 610 and 620 may be obtained by subtracting an unsafe area 605 from the applique pattern area 600 which may be set beforehand by processing to set safety areas at S17 of FIG. 21. A configuration of sewing data of the applique pattern is the same as that of Example 1 shown in FIG. 7 and so further discussion is not necessary.

Figure 21:
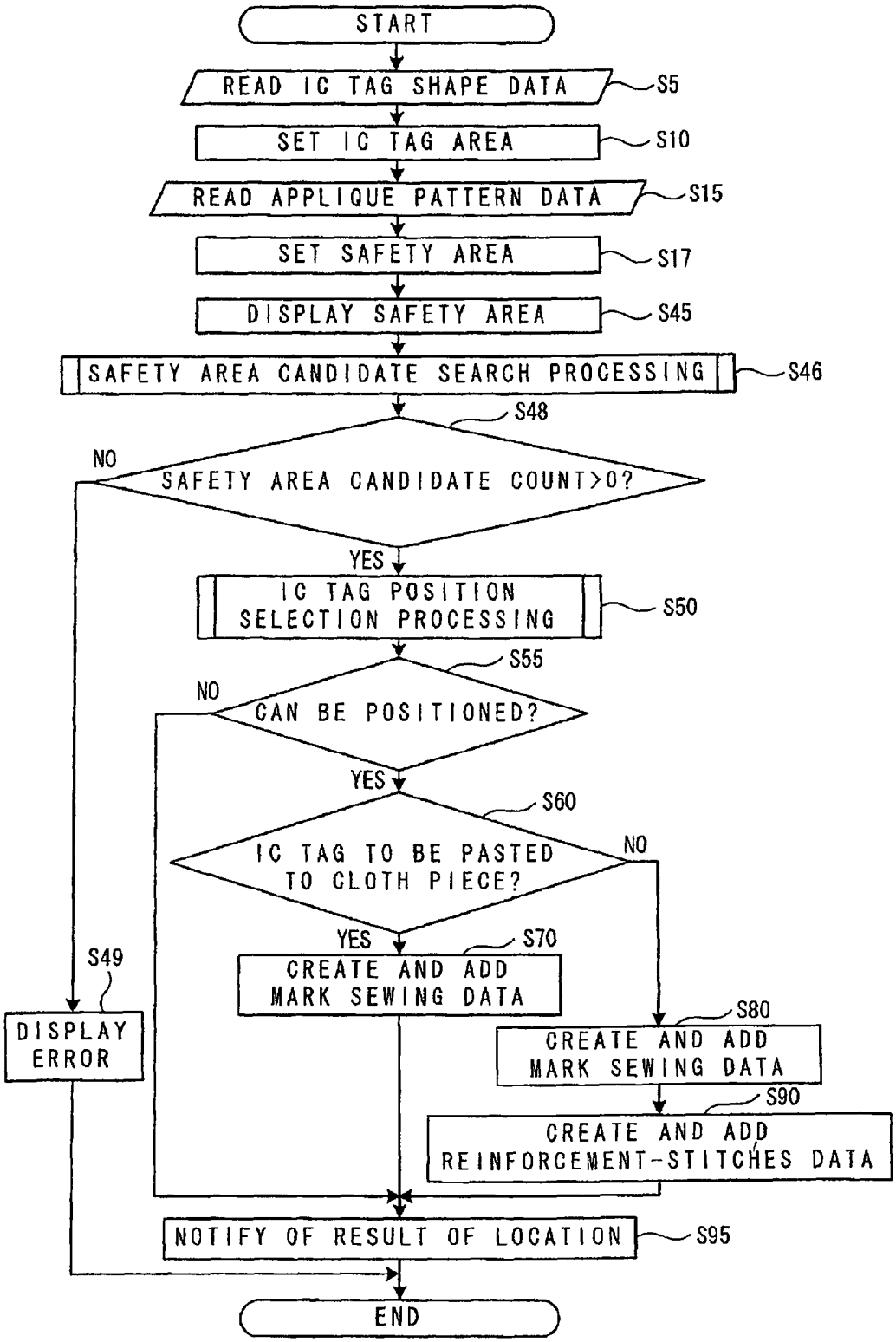
FIG. 21 is a flowchart illustrating a main processing of a third embodiment.

Next, main processing of the third embodiment will be described with reference to FIGS. 20 through 25. The main processing of the third embodiment shown in FIG. 21 is different from the main processing of the first embodiment shown in FIG. 8 in that it does not perform the processing of S20 but does perform the processing pieces of S45, S46, and S48 through S50 of the main processing of the first embodiment shown in FIG. 8. In the following description, the processing common to both of the main processing of the first embodiment will be omitted, to describe in detail S45, S46 and S48 through S50 which are not performed in the main processing of the first embodiment shown in FIG. 8.

In the main processing of the third embodiment, it may be determined beforehand which ones of the safety areas set in the applique pattern area can include an IC tag area, Then, the safety areas that can include the IC tag areas may be determined as an includable area. The includable areas may be displayed on an LCD 15, and a user may select one of the includable areas, which are a candidate for positioning the IC tag area therein. At S45 of the main processing of FIG. 21, first, the safety areas set at S17 may be displayed on the LCD 15 (S45). This processing permits the user to confirm the safety areas set at S17. Subsequently, the safety area candidate search processing may determine the safety areas that provide candidates for positioning the IC tag area therein (S46). This safety area candidate search processing will be described with a flowchart shown in FIG. 22.

Figure 22:
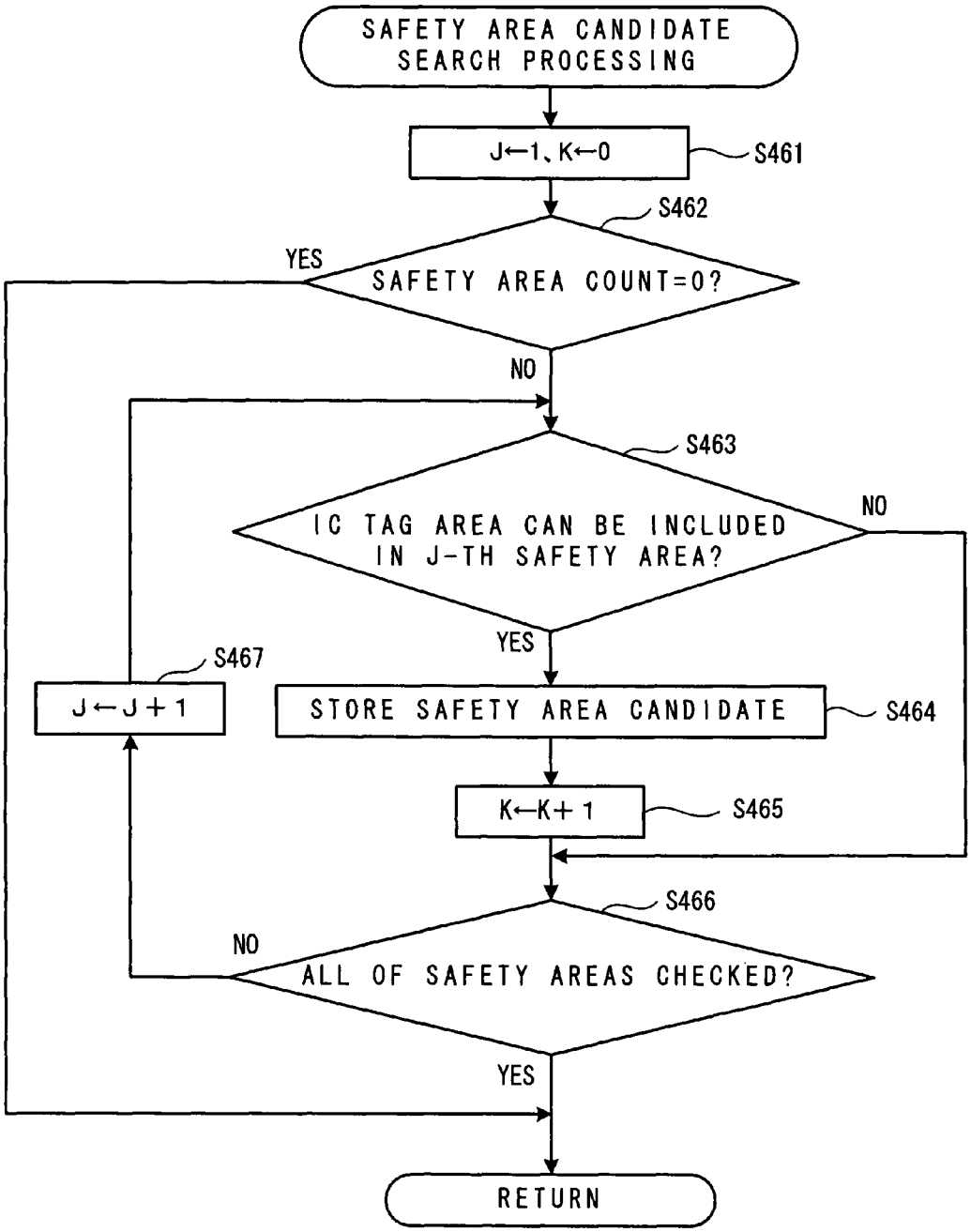
FIG. 22 is an explanatory flowchart of safety area candidate search processing which is performed in the main processing shown in FIG. 21.
Figure 23:
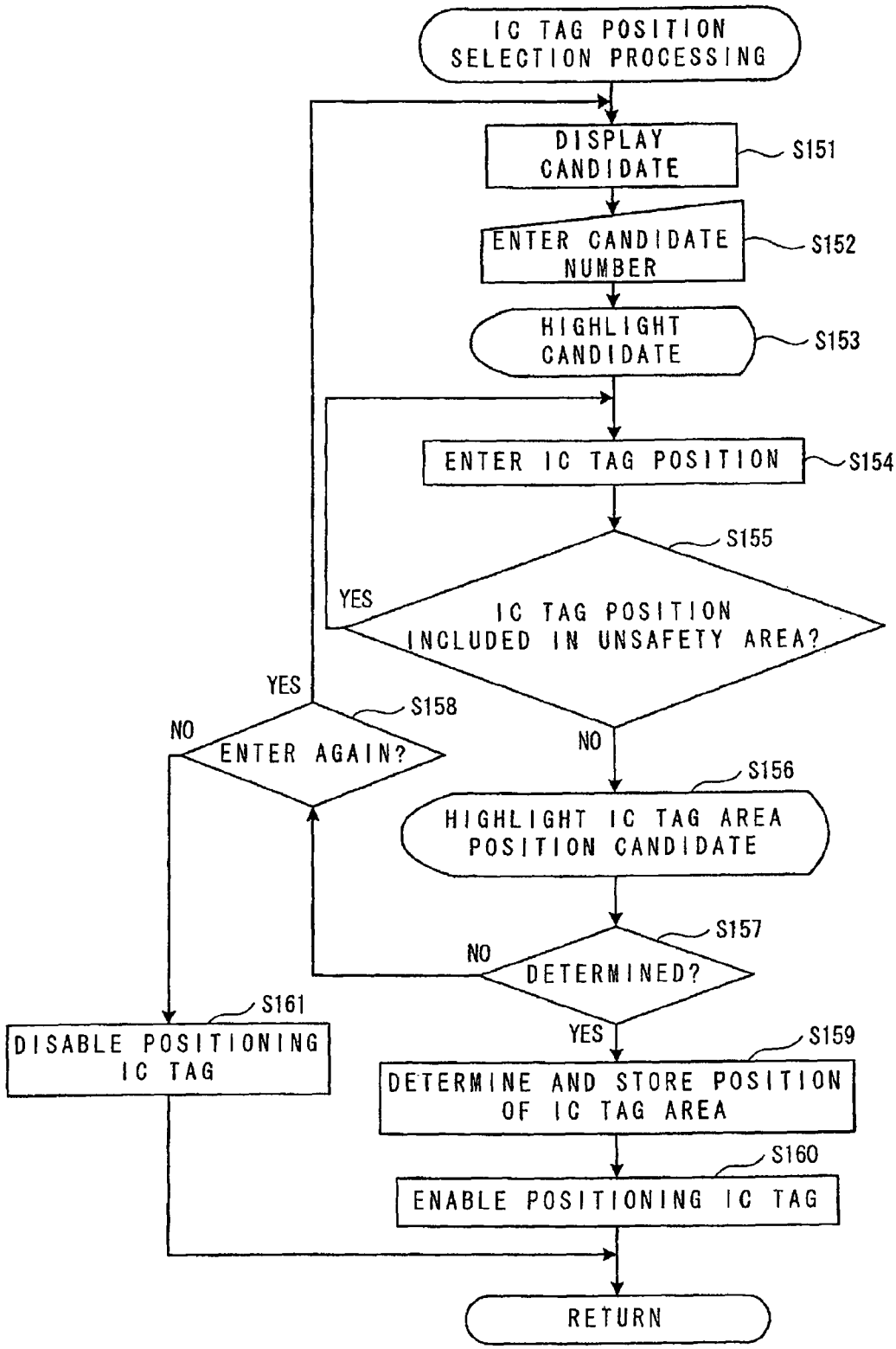
FIG. 23 is a flowchart illustrating an IC tag position selection processing which is performed in the main processing shown in FIG. 21.

In the safety area candidate search processing shown in FIG. 22, first, "1" may be set to a safety area counter J, which may be used to read the safety areas set at S17 of FIG. 21 in sequence, and the safety area counter J is stored in a safety area counter storage area 635 (S461). Further, "0" may be set to a safety candidate counter K, which may be used to count safety area candidates, and stored in a safety area candidate counter storage area (not shown) in the RAM 63 (S461). Subsequently, a safety area storage area 634 may be referred to in order to determine whether the number of the available safety areas is 0 (S462). If the number of the safety areas available is 0, it may be determined that there is no safety area to position the IC tag area therein and the safety area candidate search processing may end and the process may return to the main processing shown in FIG. 21.

On the other hand, if having determined that there is at least one safety area as in the case of Example 2 (NO at S462), it may be determined whether the IC tag area can be included in a J-TH safety area. The processing may be determined by the same processing as that of S24 of FIG. 10, for example. If having determined that the IC tag area cannot be included in the J-TH safety area (NO at S463), whether all of the safety areas are read may be determined (S466).

Figure 24:
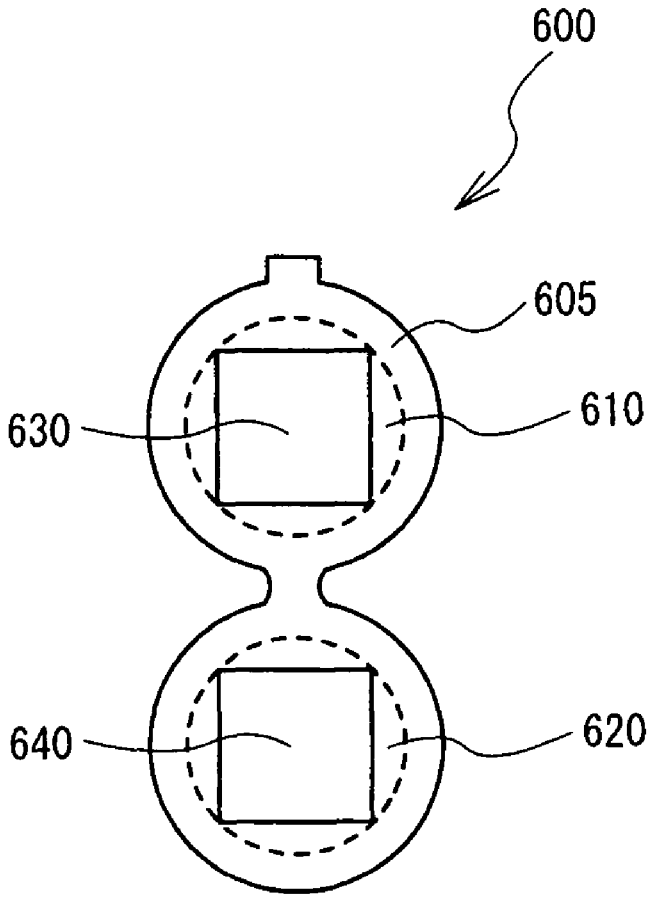
FIG. 24 is an explanatory diagram of candidates for an includable area determined by the safety area candidate search processing shown in FIG. 22.
Figure 25:
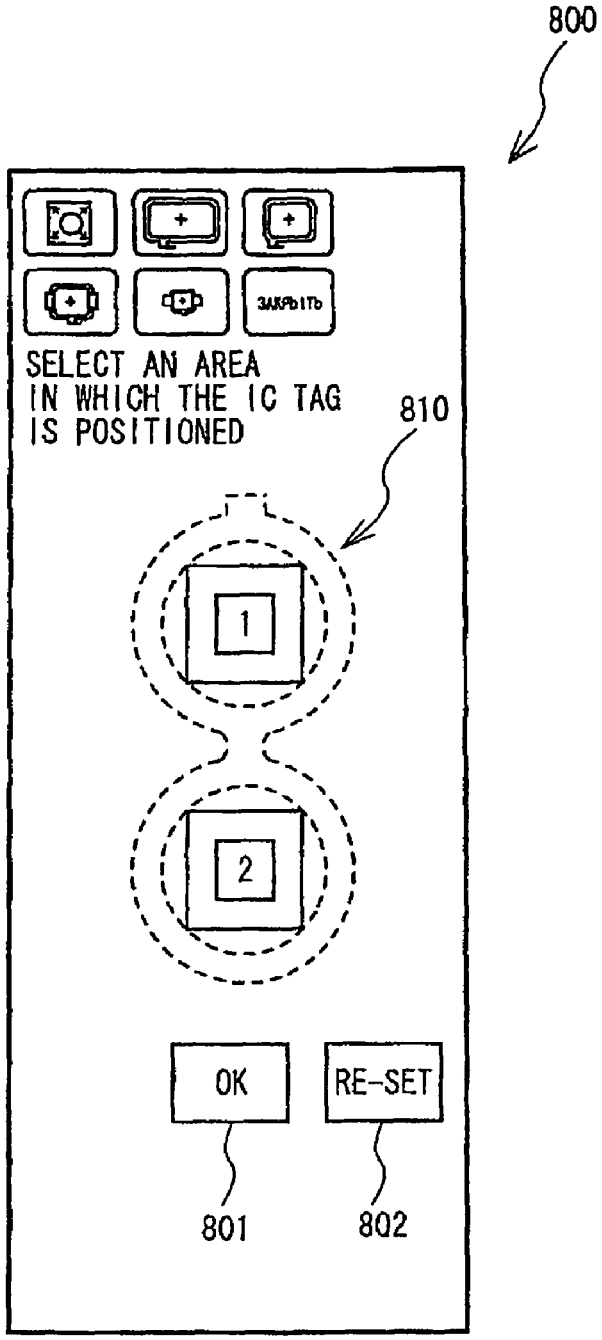
FIG. 25 is an explanatory diagram of a screen which is displayed on an LCD (liquid crystal display) 15 in the IC tag position selection processing shown in FIG. 23.

On the other hand, in Example 2, it may be determined at S463 that the IC tag area can be included in the first safety area (YES at S463) and an includable area out of the safety areas that is capable of including the IC tag area therein as a safety area candidate may be stored in an includable area storage area (not shown) in the RAM 63 (S464). In this processing, for example, relocation of the IC tag area to a relatively different position with respect to the applique pattern area may be repeated and, upon each relocation, whether the IC tag area is included in the safety area set in the applique pattern area may be determined. It should be noted that relocation is generally performed on such a predetermined condition that, for example, all of the locations should be combined. As a result, if having determined that the IC tag area can be included in the safety area, an area where the IC tag area and the applique pattern area overlap may be stored in the includable area storage area (not shown) of the RAM 63 as an includable area. Thus, the includable area may be determined. As shown in FIG. 24, an includable area 630 in the safety area 610 of Example 1 may be determined and stored in the includable area storage area (not shown) in the RAM 63. Subsequently, the safety candidate counter K may be incremented by 1 and stored in the safety area candidate counter storage area (not shown) (S461).

Subsequently, at S466, the safety area storage area 634 and the safety area counter storage area 635 may be referred to in order to determine whether all of the safety areas have been read (S466). This processing may be performed to check if each of the safety area can include the IC tag area, thereby searching for safety area candidates. In Example 2, as shown in FIG. 20, it may be determined that there are two safety areas and the second safety area 620 is yet to be read (NO at S466). Therefore, subsequently, in order to read the next safety area, the safety area counter J may be incremented by 1 and stored in the safety area counter storage area 635 (S461). Then, the process may return to S463.

By much the same processing, an includable area 640 may be determined in the safety area 620 of Example 2 and may be stored in the includable area storage area (not shown) in the RAM 63 (S464). Then, the safety candidate counter K incremented by 1 (K=2) may be stored in the safety area candidate counter storage area (not shown) in the RAM 63 (S465). Then, it may be determined that all of the safety areas are read (YES at S466). Through the above processing, includable areas may be determined and the number of safety area candidates may be obtained which is the number of the safety areas determined to be capable of including the IC tag area. Then, the safety area candidate search processing may end and the process may return to the main processing shown in FIG. 21.

Following S46 of FIG. 21, the safety area candidate counter storage area (not shown) may be referred to in the RAM 63 to determine whether the number of the safety area candidates is larger than 0 (S48). If having determined that the number of the safety area candidates is 0 (NO at S48), it may be determined that the IC tag area cannot be positioned in a safety area set in the applique pattern area. Consequently, an error message to that effect may be displayed on an LCD 15 (S49). Then, the main processing may end.

On the other hand, in Example 2, the number of the safety area candidate is 2 and it may be determined that the number is larger than 0 (YES at S48), so that IC tag position selection processing may be performed subsequently. This IC tag position selection processing will be described below with reference to a flowchart shown in FIG. 23. In the IC tag position selection processing of FIG. 23, first the includable area determined at S46 of FIG. 21 may be displayed on the LCD 15 as a candidate for locating the IC tag area therein (S151). Through the processing, it may be assumed that the includable area of Example 2 has been displayed as a screen 800 shown in FIG. 25. By selecting button 1 or button 2 on the screen 800, the user can specify an includable area in which the IC tag area is to be positioned.

Subsequently, if an includable area in which to position the IC tag area is selected and entered on a touch panel 26 (S152), it may be highlighted in such a manner as to be differentiated from the other includable areas (S153). In Example 1, "1" which selects the former from among the includable areas 630 and 640 is supposed to have been entered, so that the LCD 15 may indicated the includable area 630, for example, in a color different from that of the other includable area 640 (S153).

Subsequently, on the touch panel 26, a position to which an IC tag is to be positioned is entered in such a manner that the IC tag area may be positioned to any position in the includable area highlighted at S153 (S154). This processing may be performed to position the IC tag area to a desired position in the safety area selected at S152. Subsequently, if the IC tag area is positioned to the position entered at S153, whether the IC tag area enters an unsafe area is determined (S155). Since the position of the IC tag area is entered by the user at S154, the IC tag area may enter the unsafe area depending on the entered position. The processing at S154 may be performed to cause the user to enter the position of the IC tag again if the IC tag area enters the unsafe area (YES at S155), and enable the user to input the position of the IC tag area in includable area only.

If having determined at S155 that the IC tag area does not enter the unsafe area (NO at S155), a candidate for the position to which the IC tag area is positioned is highlighted (S156). By this processing, for example, the IC tag area entered at S154 may be displayed in a color different from the other areas. Subsequently, if an instruction which determines positioning the IC tag area entered at S154 is entered by pressing a button 801 on the screen 800 (YES at S157), the location of the IC tag area may be determined to be the specified position in the includable area entered at S154 and may be stored in an IC tag area location storage area 637 (S159). Subsequently, an IC tag location flag may be set to "1" and stored in an IC tag location flag storage area 636 (S160). Then, the IC tag position selection processing may end and the process may return to the main processing shown in FIG. 21.

On the other hand, if the instruction which determines positioning the IC tag area in the includable area highlighted at S156 is not entered but, instead, an instruction to enter a candidate number again is entered by pressing a button 802 on the screen 800 (NO at S157, YES at S158), the process may return to S151 to repeat the processing. If the user fails to enter, through the touch panel 26, an instruction to determine positioning of the IC tag area in the includable area highlighted at S156 and also fails to enter an instruction to enter the candidate number again (NO at S157, NO at S158), it may be determined that the IC tag area will not be positioned in the safety area. Subsequently, the IC tag location flag may be set to "0", which indicates that the IC tag area cannot be positioned in the safety area set in the applique pattern area, and stored in the IC tag location flag storage area 636 (S161). Subsequently, the IC tag position selection processing may end and the process may return to the main processing shown in FIG. 21.

As described in detail above, in the sewing machine 1 equipped with a sewing data processing apparatus of the third embodiment, the applique pattern areas capable of positioning an IC tag area therein may be determined as includable areas so that one of these includable areas may be selected as an area to position the IC tag area therein. Then, the IC tag area may be set to an indicated position in the selected includable area.

As detailed above, according to the sewing machine 1 equipped with the sewing data processing apparatus of the third embodiment, the touch panel 26 may be provided on which the user may indicate the position to which the IC tag area is to be positioned in the includable area displayed on the LCD 15. Therefore, it is possible to set the position of an IC tag area to a desired position in a notified includable area.

It should be noted that the present disclosure is not limited to the third embodiment described in detail above and can be changed in a variety of manners without departing from the spirit and scope of this disclosure, as characterized in the appended claims.

Although the third embodiment has used the touch panel 26, it may be replaced with any one of various switches, a trackball, or a joystick on a game controller that interfaces with the user. Further, although the third embodiment has used the LCD 15, the present disclosure is not limited to LCD displays; any other display device such as a plasma display or an audio device that uses a voice notification such as a speaker may be employed instead.

In the above-described first through third embodiments, the applique pattern area has been determined on the basis of applique pattern data stored beforehand in the predetermined storage area, to determine whether the IC tag area can be positioned in the applique pattern area. However, as in a fourth embodiment to be described next, an applique pattern area may be determined on the basis of a specified profile to determine whether an IC tag area can be positioned in the applique pattern area, and if it is determined that the IC tag can be positioned in the applique pattern area, applique pattern data for a specified applique pattern area may be created newly. The following will describe, with reference to FIGS. 26 and 27, processing to use a sewing machine 1 equipped with a sewing data processing apparatus of the fourth embodiment to, if it is determined that an IC tag area can be positioned in an applique pattern area determined on the basis of a specified profile, newly create applique pattern data for a specified applique pattern area. It should be noted that programs to perform various kinds of processing pieces shown in FIG. 26 may be stored in a ROM 62 beforehand and executed by a CPU 61 shown in FIG. 2. Further, various kinds of information required to perform the various processing pieces shown in FIG. 26 may be read from the ROM 62, an EEPROM 64, or an external storage device 39 and may be stored in a predetermined storage area in the RAM 63 beforehand.

A physical configuration and an electrical configuration of the sewing machine 1 equipped with a sewing data processing apparatus in the fourth embodiment are the same as those of the first embodiment except for storage areas of an RAM 63. Therefore, description of the features shared with the first embodiment are omitted and, instead, the storage areas of the RAM 63 which are different in configuration from those of the first embodiment will be described below. In addition to the storage areas of the RAM 63 of the first embodiment shown in FIG. 3, the RAM 63 of the fourth embodiment has a profile line storage area (not shown) which may store profile line data and an pattern area storage area (not shown) which may store an applique pattern area.

Figure 26:
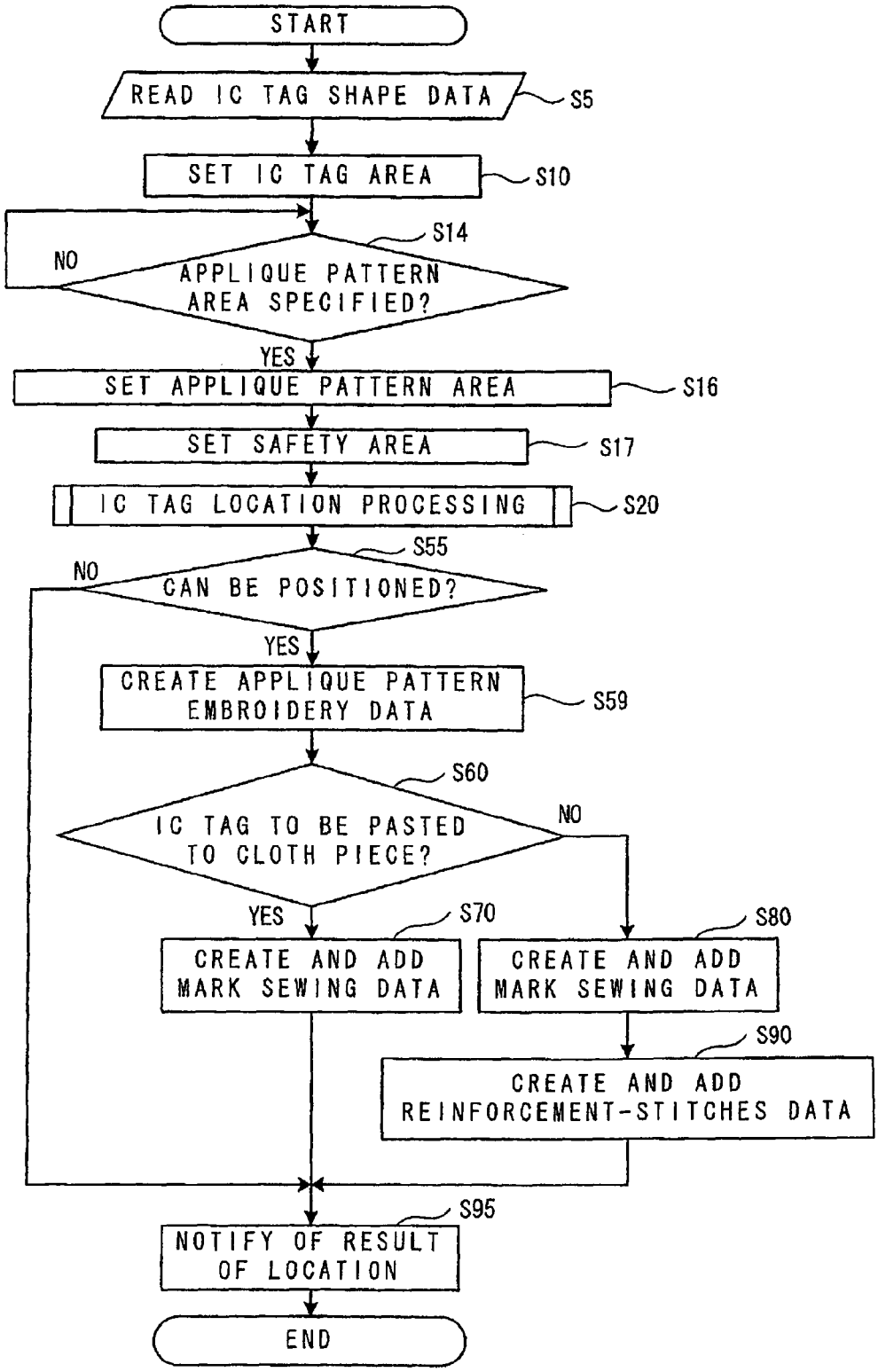
FIG. 26 is a flowchart illustrating a main processing of a fourth embodiment.

Main processing of the fourth embodiment shown in FIG. 26 is different from the main processing of the first embodiment shown in FIG. 8 in that it does not perform the processing of S15 but does perform the processing pieces of S14, S16, and S59. In the following, the processing common to both of the main processing of the first embodiment will be omitted, to describe in detail S14, S16 and S59 which are not performed in the main processing of the first embodiment shown in FIG. 8.

In the main processing of the fourth embodiment, an applique pattern area may be set based on a graphic profile specified by a user, a safety area may be set based on the applique pattern area. Then, it may be determined whether an IC tag can be positioned in that safety area and, if having determined that the IC tag area can be positioned in that safety area, applique pattern data having the specified profile as a profile of an applique pattern area may be newly created. Therefore, at S14 of FIG. 26, when a profile of an applique pattern is entered, it may be determined whether an applique pattern area is specified (S14). This processing may be performed to set an applique pattern area based on a graphic profile specified by the user. The profile may be entered, for example, by entering a profile of an applique pattern with a touch pen etc. into a sewable area displayed on an LCD 15. Further, a profile line may be extracted from images such as photos and illustrations specified by the user which are stored beforehand in a ROM 62 or an external storage device 39. Still further, the profile line may be extracted from images acquired from an image scanner sensor 27.

Figure 27:
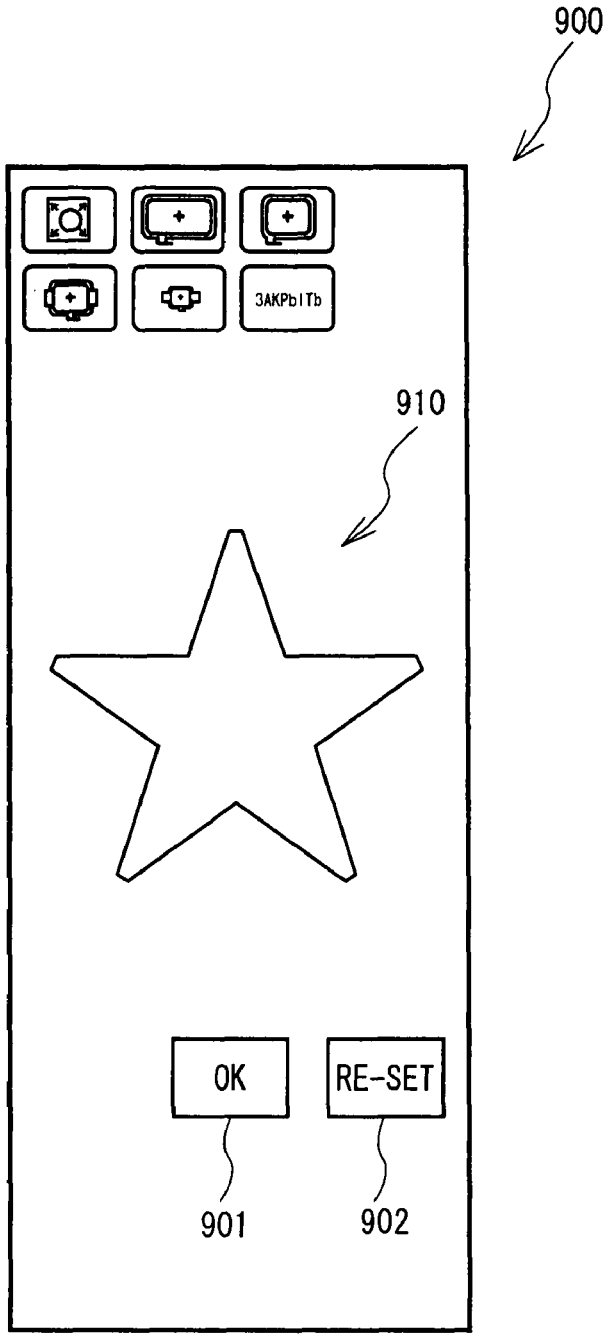
FIG. 27 is an explanatory diagram of a screen which displays a profile of an applique pattern specified by the main processing shown in FIG. 26.

If having determined at S14 that no applique pattern areas are specified because no profile lines are specified by the user (NO at S14), the next processing is generally not performed until a profile line is specified. On the other hand, if having determined that profile line is specified by the user and an applique pattern area is specified (YES at S14), the profile line data indicative of the profile line may be stored in a profile line storage area (not shown) in the RAM 63. Based on a subsequently specified profile line, an area enclosed by the profile line may be set as an applique pattern area and may be stored in an applique pattern area storage area (not shown) in the RAM 63 (S16). In the processing, as Example 3, a star-shaped profile 910 such as shown in FIG. 27 is assumed to be entered using the touch pen and an applique pattern area has been set such as an applique pattern area 210 shown in FIG. 6.

Next, processing of S59 will be described below. At S59, the profile line storage area (not shown) and the applique pattern area storage area (not shown) in the RAM 63 may be referred to in order to create applique pattern data having the profile entered at S14 as a profile of an applique pattern. Then, the applique pattern data may be stored in an applique pattern data storage area 633 (S59). To create the applique pattern data, a heretofore known method can be employed for creating applique pattern data. By this processing, of the applique pattern data of Example 3, for example, the above-described applique pattern data shown in FIG. 8 may be created and stored in the applique pattern data storage area 633.

As described in detail above, in the sewing machine equipped with a sewing processing apparatus of the fourth embodiment, an applique pattern area may be set on the basis of a specified profile of an applique pattern, to determine whether an IC tag area can be included in that applique pattern area. Also, simultaneously, if having determined that the IC tag area can be included, the applique pattern data of an applique pattern having the specified profile can be created.

According to the above-described sewing machine 1 equipped with the sewing data processing apparatus of the fourth embodiment, an applique pattern area may be set on the basis of a profile of an applique pattern specified, to determine whether an IC tag area can be included in that applique pattern area. Also, simultaneously, if having determined that the IC tag area can be included, the applique pattern data of an applique pattern having the specified profile may be created. It is thus possible to newly create data of an applique pattern so that an IC tag is covered by the applique pattern.

It should be noted that the present disclosure is not limited to the fourth embodiment described in detail above and can be changed in a variety of manners without departing from the spirit and scope of this disclosure, as characterized in the appended claims.

For example, although the fourth embodiment has used the touch panel 26, it may be replaced with any one of various switches, a trackball, or a joystick on a game controller that interfaces with the user.

According to the above-described sewing data processing apparatus and a computer-readable recording medium in which a sewing data processing program for causing the sewing data processing apparatus to perform processing may be recorded, it is possible to set positions of an applique pattern area and an IC tag area of an IC tag attached to the work cloth, in such a manner that the IC tag area may be included in the applique pattern area. Therefore, according to locations of an applique pattern area and an IC tag area set by a sewing data processing apparatus of the present disclosure, it may be possible to cover an IC tag attached to the work cloth by the cloth piece on which the applique pattern is formed, so that the IC tag capable of holding a lot of information can be attached to the work cloth without damaging a design of the work cloth.

Further, according to the above-described sewing data processing apparatus and a computer-readable recording medium in which a sewing data processing program for causing the sewing data processing apparatus to perform processing is recorded, in a case where an applique pattern area and an IC tag area are specified to the desired positions in a sewable area, it is possible to set the applique pattern area and the IC tag area to the specified positions based on whether the IC tag area is included in that applique pattern area.

Further, according to a sewing machine equipped with the above-described sewing data processing apparatus, the above-described sewing data processing apparatus is provided, so that similar advantages as those described above in connection with the apparatus can be obtained.

What is claimed is:

1. A sewing data processing apparatus which processes sewing data used to sew a cloth piece having a size and shape which is determined by applique pattern data to a work cloth by using a sewing machine so that an applique pattern including the cloth piece may be formed on the work cloth, the apparatus comprising:

an IC tag area acquisition device that acquires an IC tag area which is determined on the basis of a size and shape of an IC tag;

a determination device that determines whether the IC tag area can be included in an applique pattern area which is determined on the basis of the applique pattern data; and a location setting device that, if the determination device determines that the IC tag area can be included in the applique pattern area, sets positions of the applique pattern area and the IC tag area in a sewable area of the sewing machine in such a manner that the IC tag area is positioned in the applique pattern area.

2. The sewing data processing apparatus according to claim 1, wherein the determination device comprises:

an initial location device that positions the applique pattern area and the IC tag area in the sewable area;

a location repeating device that repeatedly repositions the applique pattern area and the IC tag area to relatively different positions until a predetermined condition is satisfied;

an inclusion determination device that, if the applique pattern area and the IC tag area are positioned by the initial location device or the location repeating device, determines whether the IC tag area is included in the applique pattern area; and an overall determination device that, if the inclusion determination device determines at least once that the IC tag area is included in the applique pattern area, determines that the IC tag area can be included in the applique pattern area.

3. The sewing data processing apparatus according to claim 1, further comprising:

a position information acquisition device that acquires position information which indicates a position of the IC tag in the sewable area of the sewing machine, wherein if the determination device determines that the IC tag area can be included in the applique pattern area, the location setting device causes the IC tag area to be positioned in the applique pattern area, and sets the position of the applique pattern area in the sewable area of the sewing machine in a condition where the position of the IC tag is fixed to the position corresponding to the position information acquired by the position information acquisition device.

4. The sewing data processing apparatus according to claim 1, further comprising:

an applique pattern data creation device that creates the sewing data, a profile specification device that specifies a profile of the applique pattern; and an applique pattern area determination device that determines the applique pattern area at least based on the profile of the applique pattern, wherein the determination device determines whether the IC tag area can be included in the applique pattern area, and if the determination device determines that the IC tag area can be included in the applique pattern area, the applique pattern data creation device creates the sewing data used to sew the applique pattern having the profile specified by the profile specification device.

5. The sewing data processing apparatus according to claim 1, further comprising:

a first indication device that, if the determination device determines that the IC tag area can be included in the applique pattern area, indicates an includable area which can include the IC tag area out of the applique pattern areas; and a selection device that selects the includable area in which the IC tag area is positioned out of the includable areas indicated by the first indication device, wherein the location setting device sets positions of the applique pattern area and the IC tag area in the sewable area of the sewing machine in such a manner that the IC tag area may be positioned in the includable area selected by the selection device.

6. The sewing data processing apparatus according to claim 1, further comprising:

a form information acquisition device that acquires form information that represents at least the size and shape of the IC tag, wherein the IC tag area acquisition device acquires the IC tag area which is determined based on at least the form information acquired by the form information acquisition device.

7. The sewing data processing apparatus according to claim 1, further comprising:

a form information input device that inputs form information that represents at least the size and shape of the IC tag, wherein the IC tag area acquisition device acquires the IC tag area which is determined based on at least the form information inputted by the form information input device.

8. The sewing data processing apparatus according to claim 1, further comprising:

a safety area determination device that determines a safety area in which the IC tag area can be positioned in the applique pattern area based on a profile of the applique pattern, a seam allowance used when sewing the cloth piece to the work cloth on which the applique pattern is formed, and a shrinkage of at least one of the work cloth and the cloth piece, wherein the determination device determines whether the IC tag area can be included in the safety area; and if the determination device determines that the IC tag area can be included in the safety area, the location setting device sets positions of the applique pattern area and the IC tag area in the sewable area of the sewing machine in such a manner that the IC tag area is positioned in the safety area.

9. The sewing data processing apparatus according to claim 1, further comprising:

a mark sewing data creation device that creates mark sewing data used to form stitches on the work cloth or the cloth piece that serve as a mark when positioning the IC tag to the position set by the location setting device.

10. The sewing data processing apparatus according to claim 9, wherein the applique pattern data at least contains profile data to form profile stitches along a profile of the cloth piece and positioning data to form positioning stitches on the work cloth to position the cut out cloth piece on the work cloth; and the sewing data processing apparatus comprises a data addition device that in a case where the IC tag is fixed to the cloth piece, adds the mark sewing data immediately before or immediately after the profile data; and in a case where the IC tag is fixed to the work cloth, adds the mark sewing immediately before or immediately after the positioning data.

11. The sewing data processing apparatus according to claim 1, further comprising a reinforcement-stitches data creation device that creates reinforcement-stitches data used to form stitches with which to sew the IC tag to the work cloth at the position set by the location setting device.

12. The sewing data processing apparatus according to claim 1, further comprising a second indication device that indicates at least one of a result of the determination made by the determination device and the location determined by the location setting device.

13. A sewing data processing apparatus which processes sewing data used to sew a cloth piece having a size and shape which is determined by applique pattern data to a work cloth by using a sewing machine so that an applique pattern including the cloth piece may be formed on the work cloth, the apparatus comprising:

an IC tag area acquisition device that acquires an IC tag area which is determined on the basis of a size and shape of an IC tag;

a location specification device that specifies a position of an applique pattern area obtained on the basis of the applique pattern data and a position of the IC tag area in a sewable area of the sewing machine;

a determination device that determines whether the IC tag area is included in the applique pattern area when the IC tag area and the applique pattern area are positioned at the positions specified by the location specification device; and a location setting device that, if the determination device determines that the IC tag area is included in the applique pattern area, sets positions of the applique pattern area and the IC tag area to the positions specified by the location specification device in the sewable area of the sewing machine.

14. The sewing data processing apparatus according to claim 13, further comprising:

a form information acquisition device that acquires form information that represents at least the size and shape of the IC tag, wherein the IC tag area acquisition device acquires the IC tag area which is determined based on at least the form information acquired by the form information acquisition device.

15. The sewing data processing apparatus according to claim 13, further comprising:

a form information input device that inputs form information that represents at least the size and shape of the IC tag, wherein the IC tag area acquisition device acquires the IC tag area which is determined based on at least the form information inputted by the form information input device.

16. The sewing data processing apparatus according to claim 13, further comprising:

a safety area determination device that determines a safety area in which the IC tag area can be positioned in the applique pattern area based on a profile of the applique pattern, a seam allowance used when sewing the cloth piece to the work cloth on which the applique pattern is formed, and a shrinkage of at least one of the work cloth and the cloth piece, wherein the determination device determines whether the IC tag area can be included in the safety area; and if the determination device determines that the IC tag area can be included in the safety area, the location setting device sets positions of the applique pattern area and the IC tag area in the sewable area of the sewing machine in such a manner that the IC tag area is positioned in the safety area.

17. The sewing data processing apparatus according to claim 13, further comprising:

a mark sewing data creation device that creates mark sewing data used to form stitches on the work cloth or the cloth piece that serve as a mark when positioning the IC tag to the position set by the location setting device.

18. The sewing data processing apparatus according to claim 17, wherein the applique pattern data at least contains profile data used to form profile stitches along a profile of the cloth piece and positioning data used to form positioning stitches on the work cloth to position the cut out cloth piece on the work cloth; and the sewing data processing apparatus comprises a data addition device that:

in a case where the IC tag is fixed to the cloth piece, adds the mark sewing data immediately before or immediately after the profile data; and in a case where the IC tag is fixed to the work cloth, adds the mark sewing data immediately before or immediately after the positioning data.

19. The sewing data processing apparatus according to claim 13, further comprising:

a reinforcement-stitches data creation device that creates reinforcement-stitches data used to form stitches with which to sew the IC tag to the work cloth at the position set by the location setting device.

20. The sewing data processing apparatus according to claim 13, further comprising:

a second indication device that indicates at least one of a result of the determination made by the determination device and the position determined by the location setting device.

21. A computer-readable recording medium storing a sewing data processing computer program which processes sewing data used to sew a cloth piece having a size and shape which is determined by applique pattern data to a work cloth by using a sewing machine so that an applique pattern including the cloth piece may be formed on the work cloth, the program comprising:

IC tag area acquisition instructions for acquiring an IC tag area which is determined on the basis of a size and shape of an IC tag;

determination instructions for determining whether the IC tag area can be included in an applique pattern area which is determined on the basis of the applique pattern data; and location setting instructions for setting the positions of the applique pattern area and the IC tag area in a sewable area of the sewing machine in such a manner that the IC tag area is positioned in the applique pattern area if, during execution of the determination instructions, it is determined that the IC tag area can be included in the applique pattern area.

22. A computer-readable recording medium storing a sewing data processing computer program which processes sewing data used to sew a cloth piece having a size and shape determined by applique pattern data to a work cloth by using a sewing machine so that an applique pattern including the cloth piece may be formed on the work cloth, the program comprising:

IC tag area acquisition instructions for acquiring an IC tag area which is determined on the basis of a size and shape of an IC tag;

location specification instructions for specifying a position of an applique pattern area obtained on the basis of the applique pattern data and a position of the IC tag area in a sewable area of the sewing machine;

determination instructions for determining whether the IC tag area is included in the applique pattern area when the IC tag area and the applique pattern area are positioned at the positions specified during execution of the location specification instructions; and location setting instructions for setting the positions of the applique pattern area and the IC tag area to the positions specified during execution of the location specification instructions in the sewable area of the sewing machine if during execution of the determination instructions, it is determined that the IC tag area is included in the applique pattern area.

* * * * *